US007543922B2

(12) United States Patent
Kachi

(10) Patent No.: US 7,543,922 B2
(45) Date of Patent: Jun. 9, 2009

(54) LIQUID SUPPLY APPARATUS AND METHOD, AND INKJET RECORDING APPARATUS

(75) Inventor: Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 449 days.

(21) Appl. No.: 11/376,272

(22) Filed: Mar. 16, 2006

(65) Prior Publication Data

US 2006/0209142 A1 Sep. 21, 2006

(30) Foreign Application Priority Data

Mar. 18, 2005 (JP) ..... 2005-080168

(51) Int. Cl.
*B41J 2/17* (2006.01)
*B41J 29/393* (2006.01)

(52) U.S. Cl. ..... 347/84; 347/19

(58) Field of Classification Search ..... 347/84, 347/85, 19

See application file for complete search history.

(56) References Cited

U.S. PATENT DOCUMENTS

| | | | |
|---|---|---|---|
| 6,354,688 B1 | 3/2002 | Inoue et al. | |
| 2005/0168520 A1 * | 8/2005 | Mantooth et al. | 347/30 |

FOREIGN PATENT DOCUMENTS

| | | | |
|---|---|---|---|
| JP | 6-134990 A | | 5/1994 |
| JP | 8-156280 A | | 6/1996 |
| JP | 11-309881 A | | 11/1999 |
| JP | 2003-127417 A | | 5/2003 |
| JP | 2003145790 A | * | 5/2003 |
| JP | 2004-322411 A | | 11/2004 |

* cited by examiner

*Primary Examiner*—An H Do
(74) *Attorney, Agent, or Firm*—Birch, Stewart, Kolasch & Birch, LLP

(57) ABSTRACT

The liquid supply apparatus supplies liquid for ejection to a liquid ejection head. The apparatus comprises: a tank which stores the liquid; a liquid supply channel through which the liquid in the tank is conveyed to the liquid ejection head; a flow rate determination device which determines a flow rate of the liquid flowing through the liquid supply channel; a pressure loss determination device which determines a pressure loss in a whole of the liquid supply channel according to the flow rate determined by the flow rate determination device; a pressure loss modification device which is disposed in a portion of the liquid supply channel and modifies the pressure loss in the liquid supply channel; and a control device which controls the pressure loss modification device according to the pressure loss in the whole of the liquid supply channel determined by the pressure loss determination device, in such a manner that the pressure loss in the whole of the liquid supply channel remains substantially constant.

16 Claims, 15 Drawing Sheets

FIG.5

EXAMPLE 1: CONSTANT FLOW RATE, AND VARIABLE INK VISCOSITY

| TEMPERATURE (°C) | INK VISCOSITY (Pa·s) | FLOW RATE ($m^3/s$) | LENGTH OF FLOW CHANNEL A (m) | DIAMETER OF FLOW CHANNEL A (m) | LENGTH OF FLOW CHANNEL B (m) | DIAMETER OF FLOW CHANNEL B (m) | PRESSURE LOSS (Pa) | |
|---|---|---|---|---|---|---|---|---|
| 15 | 0.0135 | 1.405E-07 | 0.6 | 0.005 | 0.1 | 0.00375 | 113.3258278 | |
| 25 | 0.009 | 1.405E-07 | 0.6 | 0.005 | 0.1 | 0.003 | 113.1222873 | ⇔TYPICAL CONDITIONS |
| 35 | 0.006 | 1.405E-07 | 0.6 | 0.005 | 0.1 | 0.00256 | 113.0004515 | |

FIG.6

EXAMPLE 2: CONSTANT INK VISCOSITY, AND VARIABLE FLOW RATE

| TEMPERATURE (°C) | INK VISCOSITY (Pa·s) | FLOW RATE ($m^3/s$) | LENGTH OF FLOW CHANNEL A (m) | DIAMETER OF FLOW CHANNEL A (m) | LENGTH OF FLOW CHANNEL B (m) | DIAMETER OF FLOW CHANNEL B (m) | PRESSURE LOSS (Pa) | |
|---|---|---|---|---|---|---|---|---|
| 25 | 0.009 | 2.810E-07 | 0.6 | 0.005 | 0.1 | 0.00375 | 115.4641529 | ⇔FULL DUTY PRINTING |
| 25 | 0.009 | 1.405E-07 | 0.6 | 0.005 | 0.1 | 0.003 | 113.1222873 | ⇔TYPICAL CONDITIONS |
| 25 | 0.009 | 9.36667E-08 | 0.6 | 0.005 | 0.1 | 0.00256 | 108.1891803 | ⇔1/2 PRINT DUTY |

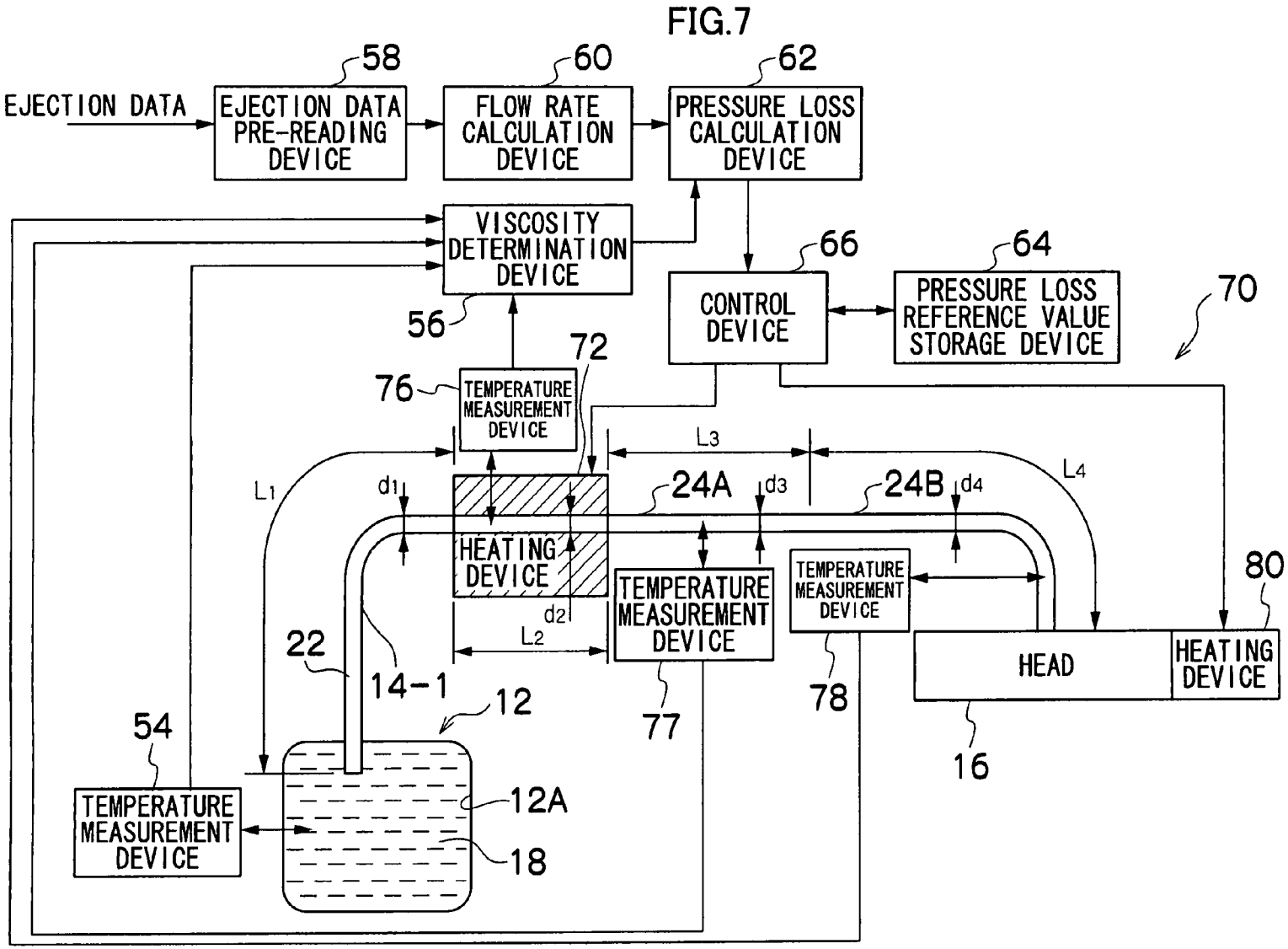
FIG.7
EJECTION DATA
EJECTION DATA PRE-READING DEVICE
58
FLOW RATE CALCULATION DEVICE
60
PRESSURE LOSS CALCULATION DEVICE
62
VISCOSITY DETERMINATION DEVICE
56
CONTROL DEVICE
66
PRESSURE LOSS REFERENCE VALUE STORAGE DEVICE
64
70
TEMPERATURE MEASUREMENT DEVICE
76
72
HEATING DEVICE
24A
24B
TEMPERATURE MEASUREMENT DEVICE
77
TEMPERATURE MEASUREMENT DEVICE
78
HEAD
16
HEATING DEVICE
80
TEMPERATURE MEASUREMENT DEVICE
54
12
12A
18
14-1
22
L1
L2
L3
L4
d1
d2
d3
d4

LIQUID SUPPLY APPARATUS AND METHOD, AND INKJET RECORDING APPARATUS

BACKGROUND OF THE INVENTION

1. Field of the Invention

The present invention relates to a liquid supply apparatus and method, and to an inkjet recording apparatus, and more particularly relates to an apparatus and method for supplying liquid for ejection to a liquid ejection head, and an inkjet recording apparatus using the liquid supply apparatus.

2. Description of the Related Art

An inkjet recording apparatus forms images by supplying ink to a print head (also called a recording head) from an ink tank, through ink supply paths, ejecting ink from nozzles of the print head by selectively driving ejection driving elements (pressure generating elements such as piezoelectric elements, heating elements or the like) corresponding to the respective nozzles, and depositing the ink droplets thus created onto a recording medium. In an inkjet recording apparatus of this kind, it is necessary to achieve stable ink ejection, and many different technologies have been proposed for this purpose.

Japanese Patent Application Publication No. 8-156280 suggests the provision of a temperature adjustment device for adjusting the temperature partially, only in prescribed sections, such as a filter member provided in an ink supply channel, in order to achieve a constant ink ejection volume and ejection frequency. By means of this composition, the negative pressure inside the ink tank is stabilized in accordance with the ink characteristics, the viscous resistance of the ink is reduced inside the ink supply channel (and especially, the filter section) during high-duty printing, and increased pressure loss in the filter section due to increased ink viscosity can be prevented. Therefore, it is possible to stabilize the ejection characteristics, even in the case of high-duty printing.

Japanese Patent Application Publication No. 2003-127417 suggests that a heating device capable of heating the vicinity of a filter interposed in an ink channel is provided, thereby heating the ink passing through the filter section and thus lowering the viscosity of the ink. Consequently, the flow resistance is reduced, stable ejection is achieved, and the replenishment (refilling) speed of the ink is increased.

However, although the method disclosed in Japanese Patent Application Publication No. 8-156280 has the beneficial effect of reducing the viscous resistance on the downstream side of a prescribed section (for example, the filter section) of the ink supply system, it does not take account of the changes in viscous resistance on the upstream side. Furthermore, in an ink supply system which uses ink of high viscosity, such as that described in Japanese Patent Application Publication No. 2003-127417, the pressure loss inside the flow channel is dependent on the ink viscosity changing with the operating temperature conditions, and is also dependent on the ink supply flow speed (ink flow rate), and this can lead to variation in the ejection characteristics of the ejection device. However, the method disclosed in Japanese Patent Application Publication No. 2003-127417 has no effect in correcting the pressure for pressure loss variations caused by change in the viscosity drag due to change in the ink flow rate. Furthermore, in Japanese Patent Application Publication No. 2003-127417, the heating system for the whole ink supply system is complicated and large in size, and the temperature control is also complicated.

SUMMARY OF THE INVENTION

The present invention has been contrived in view of the foregoing circumstances, an object thereof being to provide a liquid supply apparatus and method, and an inkjet recording apparatus using same, whereby ejection stability can be improved by maintaining the back pressure of the head at a substantially constant level at all times, regardless of the operating environment or ejection conditions (print contents, and the like).

In order to attain the aforementioned object, the present invention is directed to a liquid supply apparatus which supplies liquid for ejection to a liquid ejection head, the apparatus comprising: a tank which stores the liquid; a liquid supply channel through which the liquid in the tank is conveyed to the liquid ejection head; a flow rate determination device which determines a flow rate of the liquid flowing through the liquid supply channel; a pressure loss determination device which determines a pressure loss in a whole of the liquid supply channel according to the flow rate determined by the flow rate determination device; a pressure loss modification device which is disposed in a portion of the liquid supply channel and modifies the pressure loss in the liquid supply channel; and a control device which controls the pressure loss modification device according to the pressure loss in the whole of the liquid supply channel determined by the pressure loss determination device, in such a manner that the pressure loss in the whole of the liquid supply channel remains substantially constant.

According to the present invention, the pressure loss modification device is controlled suitably in accordance with variation in the flow rate, and the pressure loss in the whole of the liquid supply channel is kept at a substantially constant level. Therefore, it is possible to achieve stable liquid supply, regardless of variation in the flow rate, and hence ejection stability can be improved.

In the present invention, the flow rate may be determined by actually measuring (sensing) the flow rate by using a measurement device (sensor), such as a flow meter, flow speed meter, or the like, or it may be determined by means of calculation, from a predicted liquid consumption rate, or the like. Since the volume flow rate is represented by the product of the flow channel surface area and the flow speed, then the determination of the flow rate and the determination of the flow speed can be regarded as being essentially equivalent. In other words, the "flow rate determination device" stated in the present invention is not limited to a narrow interpretation of "flow rate", and it may also encompass a flow speed determination device which determines the flow speed.

Furthermore, the reference to "remains substantially constant" in the present invention means that the value is kept within a range of tolerance around the control target value in the control operation. In other words, rather than it being necessary for the pressure loss in the overall liquid supply channel to be strictly the same as the control target value, the pressure loss is controlled in such a manner that it comes within a prescribed range of tolerance of the control target value. The control target value and tolerance range are specified suitably on the basis of the specific apparatus conditions, and the like.

Preferably, the flow rate determination device calculates the flow rate from ejection data for ejecting the liquid from the liquid ejection head.

The amount of liquid (volume V) consumed within a certain prescribed time period (Δt) is predicted on the basis of the ejection data for driving the liquid ejection head (the droplet ejection data for ejecting droplets to form dots, in the case of a print head in an inkjet recording apparatus), and the amount of liquid passing through the cross-section of the liquid supply channel per unit time (in other words, the flow rate $Q=V/\Delta t$) can be determined (calculated) from the prediction result. The pressure loss in the whole liquid supply channel is determined from the flow rate Q thus calculated, and the pressure modification device is controlled on the basis of this determination result. Accordingly, it is possible to control the pressure loss in accordance with change in the ejection circumstances.

Preferably, the liquid supply apparatus further comprises: a temperature determination device which determines a temperature of the liquid in the liquid supply channel; and a viscosity determination device which determines a viscosity of the liquid according to the temperature determined by the temperature determination device, wherein the pressure loss determination device includes a calculation device which calculates the pressure loss in the liquid supply channel according to the viscosity determined by the viscosity determination device.

Since the viscosity of the liquid generally changes in accordance with the temperature of the liquid, then by determining the viscosity of the liquid from the temperature determined by the temperature determination device and calculating the pressure loss in the liquid supply channel, it is also possible to control the pressure loss with respect to variation in the temperature of the liquid (in other words, variation in the viscosity). This mode is particularly valuable in a case where liquid having properties whereby the viscosity of the liquid displays relatively large change with respect to variation in the temperature (namely, a high-viscosity liquid, or the like) is used.

In the present invention, the temperature may be ascertained by actually measuring (sensing) the temperature in the tank and/or liquid supply channel directly or indirectly, by means of a measurement device (or sensor) such as a temperature sensor, and the temperature may also be estimated by taking account of the movement of the liquid in the flow channel.

Preferably, the liquid supply apparatus further comprises: a reference value storage device which stores a prescribed reference value forming a control target value for the pressure loss in the whole of the liquid supply channel, wherein the control device performs comparison of the pressure loss in the whole of the liquid supply channel determined by the pressure loss determination device, with the reference value, and controls the pressure loss modification device according to a result of the comparison, in such a manner that the pressure loss in the whole of the liquid supply channel is substantially equal to the reference value.

According to the present invention, by comparing the pressure loss determined by the pressure loss determination device and the previously stored prescribed reference value, and controlling the amount of increase or decrease in the pressure loss with respect to the reference value, by means of the pressure loss modification device, then it is possible to make the pressure loss in the whole liquid supply channel remain substantially constant.

Desirably, the prescribed reference value specifies a reference flow rate on the basis of the normal operating environment, average ejection conditions, and the like, and it is set as the central value of the range of variation of the pressure loss modification device.

Preferably, the pressure loss modification device comprises a cross-sectional area adjustment device which adjusts a cross-sectional area of the portion of the liquid supply channel.

The pressure loss can be controlled in real time by adjusting the cross-sectional area of the flow channel.

Alternatively, it is also preferable that the pressure loss modification device comprises a heating device which heats the liquid in the portion of the liquid supply channel.

As stated above, since there is a correlation between the viscosity of the liquid and its temperature, it is possible to control the viscosity by controlling the temperature of the liquid by means of the heating device, and the pressure loss can be controlled by adjusting the viscosity. This mode is particularly valuable in a case where liquid having properties whereby the viscosity of the liquid displays relatively large change with respect to variation in the temperature (namely, a high-viscosity liquid, or the like) is used.

A mode is also possible in which the pressure loss modification device combines the cross-sectional area adjustment device and the heating device.

Preferably, the liquid supply apparatus further comprises a head heating device which heats the liquid ejection head in such a manner that a temperature of the liquid in the liquid ejection head is constantly higher than the temperature of the liquid in the liquid supply channel.

By keeping the liquid temperature in the liquid ejection head higher than the liquid temperature in the liquid supply channel at all times, it is possible to stabilize the liquid temperature in the liquid ejection head (thereby simplifying the control operation), and to stabilize the ejection characteristics.

In order to attain the aforementioned object, the present invention is also directed to a liquid supply method of supplying liquid for ejection to a liquid ejection head, the method comprising the steps of: providing a pressure loss modification device in a portion of a liquid supply channel through which the liquid in a tank storing the liquid is conveyed to the liquid ejection head, the pressure loss modification device modifying a pressure loss in the liquid supply channel; determining a pressure loss in a whole of the liquid supply channel according to a flow rate of the liquid flowing through the liquid supply channel; and controlling the pressure loss modification device according to the pressure loss determined in the pressure loss determining step, in such a manner that the pressure loss in the whole of the liquid supply channel is substantially equal to a prescribed reference value.

In order to attain the aforementioned object, the present invention is also directed to an inkjet recording apparatus, comprising: the above-described liquid supply apparatus; and the liquid ejection head which receives a supply of ink forming the liquid for ejection, from the liquid supply apparatus, wherein an image is formed on a recording medium by means of ink droplets ejected from ejection ports of the liquid ejection head.

In order to achieve a high-resolution image output, a desirable mode is one using a liquid ejection head (print head) in which a plurality of liquid droplet ejection elements (ink chamber units) are arranged, each constituted by an ejection port (nozzle) which ejects ink droplets, and a pressure chamber and pressure generating element corresponding to the ejection port.

A compositional embodiment of print head is a full line type head having a nozzle row in which a plurality of ejection ports (nozzles) are arranged through a length corresponding to the full width of the recording medium. In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type head is usually disposed in a direction that is perpendicular to the relative feed direction (relative conveyance direction) of the recording medium, but a mode may also be adopted in which the head is disposed following an oblique direction that forms a prescribed angle with respect to the direction perpendicular to the conveyance direction. "Recording medium" indicates a medium which receives the deposition of ink ejected from the ejection ports of a liquid ejection head (this medium may also be called a print medium, image forming medium, image receiving medium, liquid receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

The conveyance device for causing the recording medium and the liquid ejection head to move relatively with respect to each other may include a mode where the recording medium is conveyed with respect to a stationary (fixed) recording head, or a mode where a recording head is moved with respect to a stationary recording medium, or a mode where both the recording head and the recording medium are moved. When forming color images by means of an inkjet print head, it is possible to provide type print heads for each color of a plurality of colored inks (recording liquids), or it is possible to eject inks of a plurality of colors, from one print head.

Preferably, the flow rate determination device includes an ink flow rate calculation device which determines an ink flow rate from ejection data for ejecting the ink from the liquid ejection head.

For example, color conversion or half-toning is carried out on the basis of image data (print data) input through an image input device, thereby generating ejection data corresponding to the ink colors. The ejection drive elements corresponding to the respective nozzles of the liquid ejection head (namely, the pressure generating elements constituted by piezoelectric elements, heating elements, and the like) are driven and controlled in such a manner that ink droplets are ejected from the nozzles. It is possible to predict the ink flow rate by calculating the ink ejection volume from the ejection data.

Furthermore, by pre-reading the ejection data, predicting the ink flow rate, determining the pressure loss in the whole of the ink supply channel from the predicted ink flow rate, and controlling the pressure loss modification device in such a manner that the pressure loss is substantially constant, it becomes possible to achieve stable ink supply by minimizing variation in the back pressure of the head, irrespective of the operating environment and the print duty. Accordingly, it is possible to improve the ejection stability.

According to the present invention, it is possible to keep the internal pressure of the head (back pressure of the head) substantially constant at all times, regardless of the operating environment and ejection conditions, and hence ejection characteristics can be stabilized.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 5 is a table showing an example of numerical conditions;

FIG. 6 is a table showing another example of numerical conditions;

FIG. 7 is a block diagram showing the general composition of an ink supply apparatus in an inkjet recording apparatus according to a second embodiment of the present invention;

DETAILED DESCRIPTION OF THE PREFERRED EMBODIMENTS

First Embodiment

Figure 1:
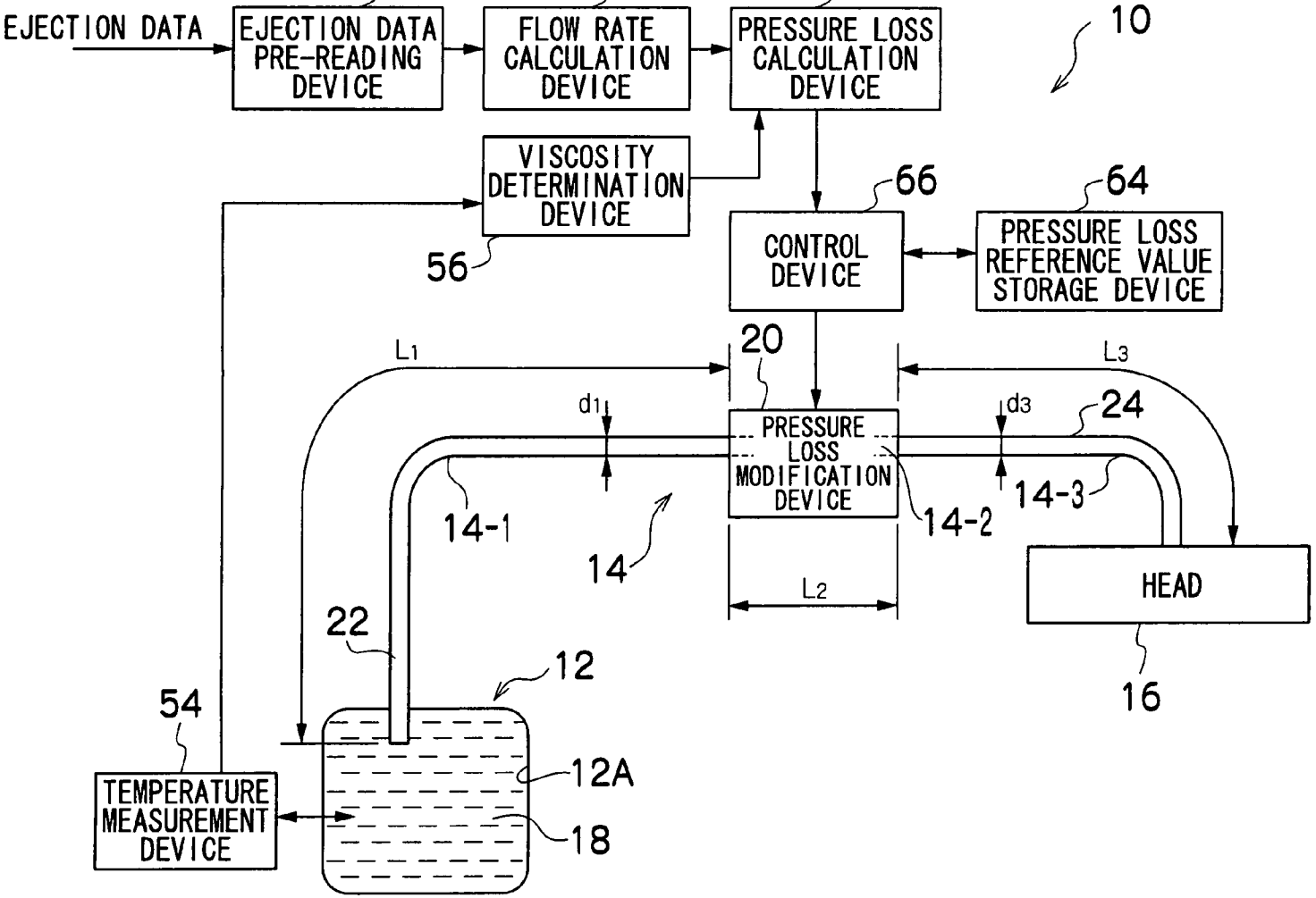
FIG. 1 is a block diagram showing the general composition of an ink supply apparatus in an inkjet recording apparatus according to a first embodiment of the present invention.

FIG. 1 is a block diagram showing the general composition of an ink supply apparatus in an inkjet recording apparatus according to a first embodiment of the present invention. As shown in FIG. 1, the ink supply apparatus 10 supplies ink 18 to a print head (corresponding to an ejection head) 16, from an ink tank 12, through an ink supply channel 14, and by controlling a pressure loss modification device 20 provided in a portion of the ink supply channel 14 in accordance with circumstances, the pressure loss in the whole ink supply channel 14 is maintained at a substantially constant level at all times.

The ink tank 12 is a main tank containing ink to be supplied. The ink tank 12 is formed by a flexible pack, and contains ink 18 sealed inside a flexible container 12A made of resin. As the volume of ink inside the ink tank 12 declines with the consumption of the ink, the container 12A inside the pack is compressed by the atmospheric pressure.

The ink tank 12 may adopt a system for replenishing ink by means of a replenishing port, or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

The ink supply channel 14 is an ink flow channel through which the ink is conveyed from the ink tank 12 to the print head 16. The ink tank 12 and the print head 16 are connected together by the ink supply channel 14, and the ink inside the ink tank 12 is supplied to the print head 16 through the ink supply channel 14. Although not shown in FIG. 1, a filter for removing foreign matter and air bubbles is provided at a suitable position of the ink supply channel 14. Desirably, the filter mesh size is the same as the nozzle diameter (the diameter of the opening of the ink ejection ports) in the print head 16, or smaller than the nozzle diameter (generally, about 20 μm).

In FIG. 1, in order to simplify the description, the ink supply channel 14 is divided into three regions. The channel from the end of the tube 22 inserted in the ink tank 12 to the upstream end of the pressure loss modification device 20 is called the first flow channel section 14-1, the channel section in the pressure loss modification device 20 is called the second flow channel section 14-2, and the flow channel of the channel 24 from the downstream end of the pressure loss modification device 20 to the inlet of the print head 16 is called the third flow channel section 14-3.

The pressure loss modification device 20 is a device which changes the pressure loss in the flow channel by acting on a portion of the ink supply channel 14 (the second flow channel section 14-2 in FIG. 1). There is no particular limit on the positioning or the number of pressure loss modification devices 20 provided in the ink supply channel 14, but preferably, the pressure loss modification device 20 is arranged in the region of maximum pressure loss in the ink supply system (for example, immediately in front of an ink filter section).

The pressure loss modification device 20 is constituted by a device which changes the cross-sectional area of the flow channel (flow channel diameter), or a heating device which heats the ink, or by a combination of these. Here, it is supposed that a mechanism (flow channel diameter modifying mechanism) which varies and controls the flow path diameter d of a prescribed flow channel length $L_2$ is used. An embodiment of the structure of this mechanism is shown in FIGS. 2A and 2B.

Figure 2B:
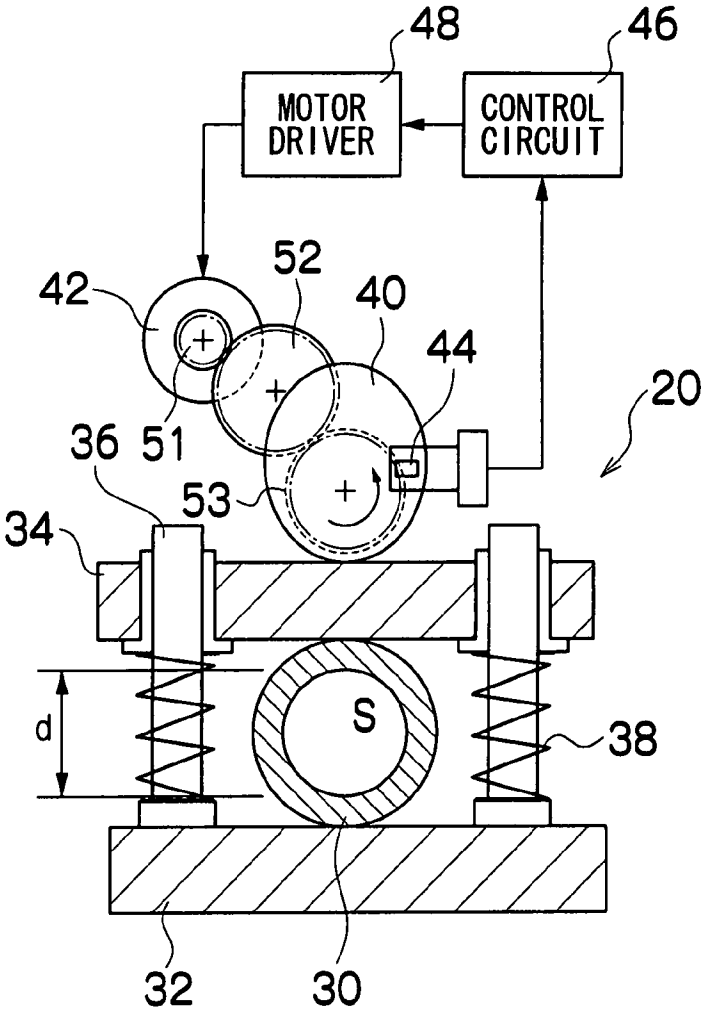
FIGS. 2A and 2B are diagrams showing a structural embodiment of a pressure loss modification device.
Figure 2A:
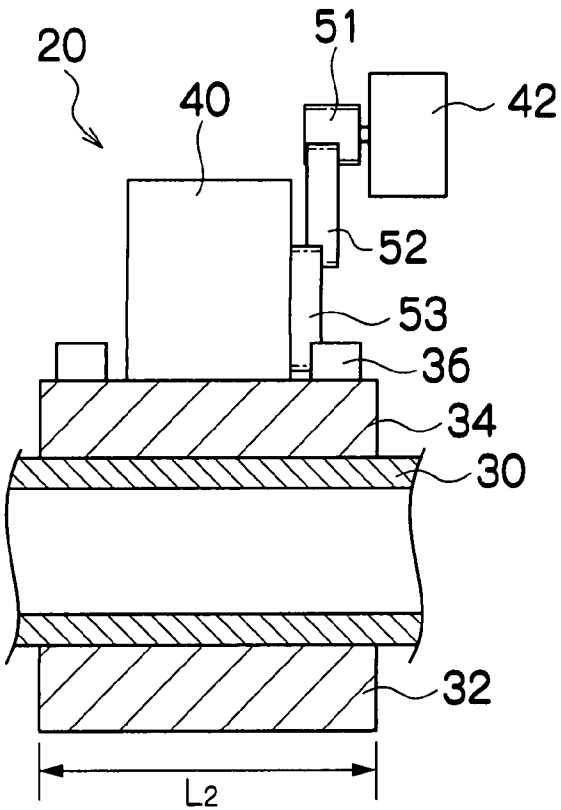

FIGS. 2A and 2B are diagrams showing embodiments of the structure of the pressure loss modification device 20. FIG. 2A is a cross-sectional diagram along a plane parallel to the flow direction of the ink, and FIG. 2B is a cross-sectional diagram along a plane parallel to a flow path cross-section, which is perpendicular to the flow direction.

The composition shown here is a structural embodiment of a system (tube diameter constriction system) in which the flow channel diameter is constricted by mechanically pressing an elastic tube 30, which is a member forming the ink flow channel. The elastic tube 30 is positioned between a fixed plate 32 and a movable plate 34, and the cross-sectional area S of the flow path is changed by parallel movement of the movable plate 34 (movement in the upward and downward direction in FIGS. 2A and 2B). The movable plate 34 is supported slidably on guide shafts 36 provided in a standing fashion on the fixed plate 32, and compression springs 38 are provided along the guide shafts 36, between the fixed plate 32 and the movable plate 34.

An eccentric cam 40, which is in contact with the movable plate 34, is provided in such a manner that the eccentric cam 40 presses the movable plate 34 toward the fixed plate 32, against the restoring force of the compression springs 38, and by driving this eccentric cam 40 by means of a motor 42, the amount through which the movable plate 34 is pressed (the amount of displacement due to the pressing action) changes and the amount of deformation of the elastic tube 30 (in other words, the cross-sectional area S of the flow channel) alters. The movable plate 34 is impelled toward the eccentric cam 40 (the upward direction) by means of the compression springs 38, and hence performs a parallel movement in accordance with the rotational position of the eccentric cam 40.

The rotational position of the eccentric cam 40 is determined by a sensor (determination device) 44, and by applying a control signal to the motor driver 48 from a control circuit (control device) 46, on the basis of the determination signal (position determination information) from the sensor 44, the rotational angle of the motor 42 is controlled, thereby controlling the cross-sectional area S of the flow channel. Since the movable plate 34 and the fixed plate 32 both have a size equal to the length $L_2$ in the direction of the flow path (see FIG. 2A), it is possible to constrict the flow path diameter in the flow path section of the length $L_2$.

Furthermore, FIG. 2A shows the mechanism in which the movement of the motor 42 is transmitted to the eccentric cam 40 by means of gears 50, 51 and 52, but the drive force transmission device is not limited to the gearwheel drive mechanism, and it is also possible to adopt another commonly known transmission mechanism, such as a belt drive mechanism using a belt, or the like.

The correlation between the pressure loss ΔP and the rotational angle of the eccentric cam 40 in the pressure loss modification device 20 may be controlled on the basis of experimental data, or it may be controlled by using the equivalent flow path diameter which corresponds to the squashed sectional area of the elastic tube 30. For example, in the case of the former method, a table of correlation data acquired by means of experimentation is stored in a memory or the like (data storage device), and the rotation of the motor 42 is controlled by referring to the table data, according to requirements. Furthermore, in the case of the latter method, calculation is made by using a prescribed calculation formula, and the rotation of the motor 42 is controlled on the basis of the calculation results.

As shown in FIG. 1, the ink supply apparatus 10 according to the present embodiment comprises, as constituent elements of a control system for controlling the pressure loss modification device 20: a temperature measurement device 54, which measures the ink temperature inside the ink tank 12; a viscosity determination device 56, which determines (estimates) the ink viscosity from the measured ink temperature; an ejection data pre-reading device 58, which reads and acquires ejection data for an image that is to be printed; a flow rate calculation device 60, which calculates the ink flow rate from the read in ejection data; a pressure loss calculation device 62, which calculates the pressure loss in the whole of the ink supply channel 14; a storage device (pressure loss reference value storage device) 64 which stores a reference value of the pressure loss when used in a normal operating environment and under average printing conditions; and a control device 66 which compares the calculation result of the pressure loss calculation device 62 with the pressure loss reference value, and controls the operation of the pressure loss modification device 20 in accordance with the result of this comparison.

The control device 66 performs the function of the control circuit 46 shown in FIG. 2B. Furthermore, for the temperature measurement device 54 shown in FIG. 1, it is possible to use a commonly known temperature sensor, which outputs an electrical signal corresponding to the temperature.

The viscosity determination device 56, the ejection data pre-reading device 58, the flow rate calculation device 60, the pressure loss calculation device 62, the pressure loss reference value storage device 64 and the control device 66 can be embodied by means of a combination of software and the processors included in the peripheral circuitry, such as the CPU and memory.

In general, the basic formula of the pressure loss ΔP of liquid flowing along a flow channel is expressed by the following Formula (1):

$$-\Delta P=128Q\mu L/(\pi d^4)=(128Q/\pi)\times(L\mu/d^4), \quad (1)$$

where Q is the ink flow rate per unit time, μ is the ink viscosity, d is the equivalent diameter of the pressure loss region (assuming a circular channel), π is the ratio of the circumference of a circle to its diameter, and L is the length of the pressure loss region.

As Formula (1) reveals, the pressure loss ΔP is dependent on the product of the flow rate Q of the fluid per unit time in the pressure loss region, and the viscosity μ of the fluid.

In the case of the composition shown in FIG. 1, taking the equivalent diameter of the first flow channel section 14-1 to be $d_1$, the tube channel length thereof to be $L_1$, the equivalent diameter of the second flow channel section 14-2 to be $d_2$, the tube channel length thereof to be $L_2$, the equivalent diameter of the third flow channel section 14-3 to be $d_3$ and the tube channel length thereof to be $L_3$, then the pressure loss ΔP for the whole ink supply channel 14 is represented by the sum total of the pressure losses in the flow channel regions 14-1, 14-2 and 14-3, as shown in the following Formula (2):

$$-\Delta P=(128Q\mu/\pi)\times\{(L_1/d_1^4)+(L_2/d_2^4)+(L_3/d_3^4)\}. \quad (2)$$

Of the parameters in Formula (2), the equivalent diameter $d_1$ and the tube channel length $L_1$ of the first flow channel section 14-1, the tube channel length $L_2$ of the second flow channel section 14-2, and the equivalent diameter $d_3$ and tube channel length $L_3$ of the third flow channel 14-3, are each fixed values, which are intrinsic to the apparatus (parameters dependent on the dimensions and shape of the apparatus in the pressure loss region), and in the present embodiment, the control factor that governs the pressure loss is the equivalent diameter $d_2$ of the second flow channel section 14-2.

Furthermore, the ink flow rate Q flowing per unit time t (here, the volume flow rate) is predicted from the ejection data, and the ink viscosity μ is determined on the basis of information relating to the ink temperature T.

Figure 3:
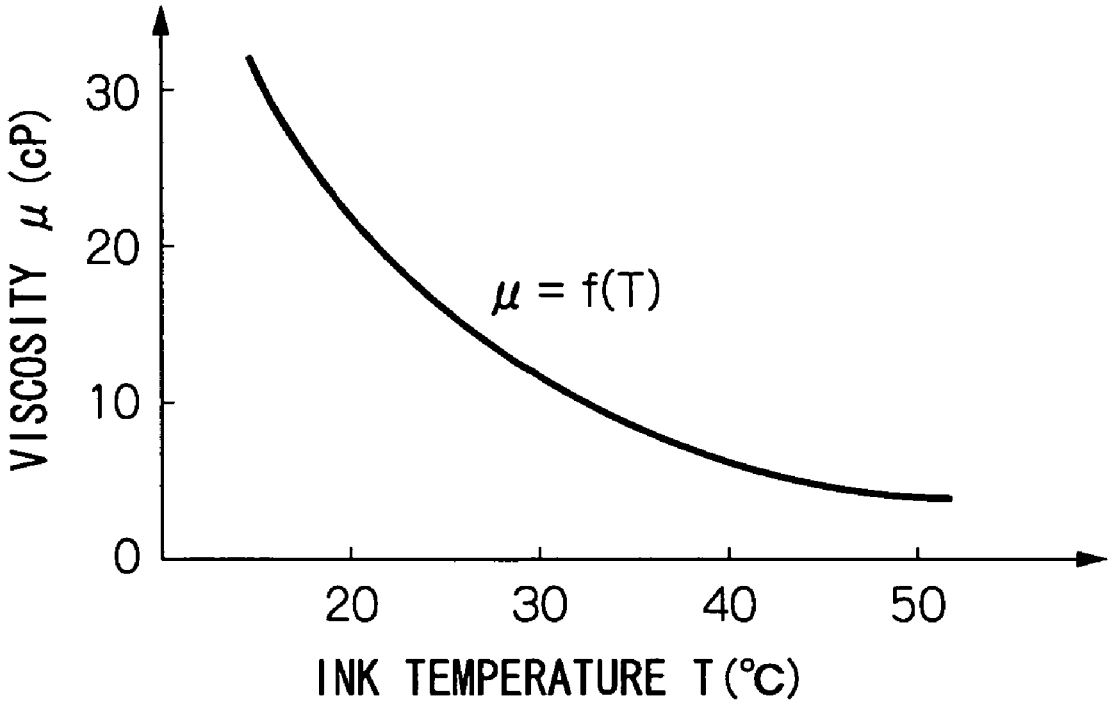
FIG. 3 is a graph showing an example of the relationship between ink viscosity and ink temperature.

FIG. 3 is a graph showing an example of the relationship between the viscosity and the temperature of the ink. The ink viscosity is dependent on the temperature, and there is a relationship of μ=f(T) between the ink viscosity μ and the ink temperature T. The concrete function f varies with the type of ink, and qualitatively, the ink viscosity μ tends to decline, as the temperature T of the ink increases as shown in FIG. 3.

Here, in a general water-based ink having a viscosity of several centipoises (cP) (1 cP=0.001 Pa·s) at normal temperature (25° C.) (an ink classified as "low-viscosity ink"), there is relatively little change in viscosity with respect to temperature, and as an approximation, it is possible to treat the viscosity as a substantially constant value. In other words, in the case of a system which handles low-viscosity ink, it is possible that the system is not provided with the temperature measurement device 54 shown in FIG. 1, and determines the ink viscosity from information relating to the ink type, or the like.

On the other hand, in the case of an ink classified as "high-viscosity ink" which shows a viscosity of 10 cP or above at a normal temperature (25° C.) (an upper limit of approximately 40 cP when considering ejection by means of an inkjet system), there is a relatively large variation in viscosity with respect to temperature, as shown by the example in FIG. 3. Consequently, in a system which handles high-viscosity ink, as shown in FIG. 1, a composition which measures the ink temperature and estimates the ink viscosity from the correlation between the ink viscosity and the temperature, is beneficial.

The viscosity determination device 56 shown in FIG. 1 comprises table data which indicates the relationship μ=f(T) shown in FIG. 3, for example, and the viscosity determination device 56 determines the ink viscosity corresponding to the temperature in question, by referring to the table data, on the basis of the information on the ink temperature T obtained by the temperature measurement device 54 in FIG. 1. Alternatively, instead of the table data, it is possible to calculate the ink viscosity μ from the ink temperature T, by using a calculation formula.

The ejection data pre-reading device 58 shown in FIG. 1 is a data reading device which pre-reads the ejection data that is to be printed after a previously established prescribed time period (after a pre-reading time differential), in relation to the print operation current in progress (or preparations for the start of printing). The data volume of the ejection data which is to be pre-read in accordance with the previously established pre-reading time differential (the number of data blocks in one image, or the number of images) is determined, and the ejection data of the print region to be printed after the pre-reading time differential is acquired. Here, the "ejection data" is the image data of lower graduation (binary dot data or multiple-value dot data taking account of changeable dot size) obtained by carrying out halftone processing with respect to the image data to be printed (multiple-value input image data), and the ejection data corresponds to the droplet ejection data for ejecting ink from the nozzles of the print head.

The flow rate calculation device 60 calculates the ink volume consumed in a prescribed time period, in other words, the ink volume (ink supply volume) to be supplied from the ink tank 12 to the print head 16 in a prescribed time period, and the flow rate calculation device 60 also calculates the ink volume flowing through the ink supply channel 14 per unit time (i.e., the flow rate Q).

The pressure loss calculation device 62 performs a calculation for finding the pressure loss in the whole ink supply channel 14, by means of a prescribed calculation formula using the flow rate Q calculated by the flow rate calculation device 60 and the viscosity μ determined by the viscosity determination device 56.

The control device 66 compares the calculation result of the pressure loss calculation device 62 (the predicted pressure loss), with the pressure loss reference value $\Delta P_0$ stored previously in the pressure loss reference value storage device 64, and controls the pressure loss modification device 20 according to the comparison results (namely, the difference or ratio between the two values) in such a manner that the overall pressure loss in the ink supply channel 14 becomes substantially equal to the pressure loss reference value $\Delta P_0$. In other words, the flow channel diameter $d_2$ of the second flow channel section 14-2 is controlled and varied in such a manner that the value of ΔP in Formula (2) becomes equal to the pressure loss reference value $\Delta P_0$. Consequently, it is possible to maintain the back pressure in the head at a substantially constant value at all times, irrespective of the printing duty, and therefore, stable ejection characteristics can be obtained.

The pressure loss reference value $\Delta P_0$ is, for example, set to be around −100 mm $H_2O$ (=−980.665 Pa) according to a head pressure conversion. The flow channel parameters of the ink supply channel 14 shown in FIG. 1 are set for a constant ink flow (reference flow rate $Q_0$) at a normal temperature of 2520 C. on the basis of the average ejection data, and furthermore, they are set in such a manner that the overall pressure loss in the ink supply channel 14 is around −100 mm $H_2O$ (=−980.665 Pa) when the pressure loss modification device 20 is set to the center value of its potential adjustment range.

Figure 4:
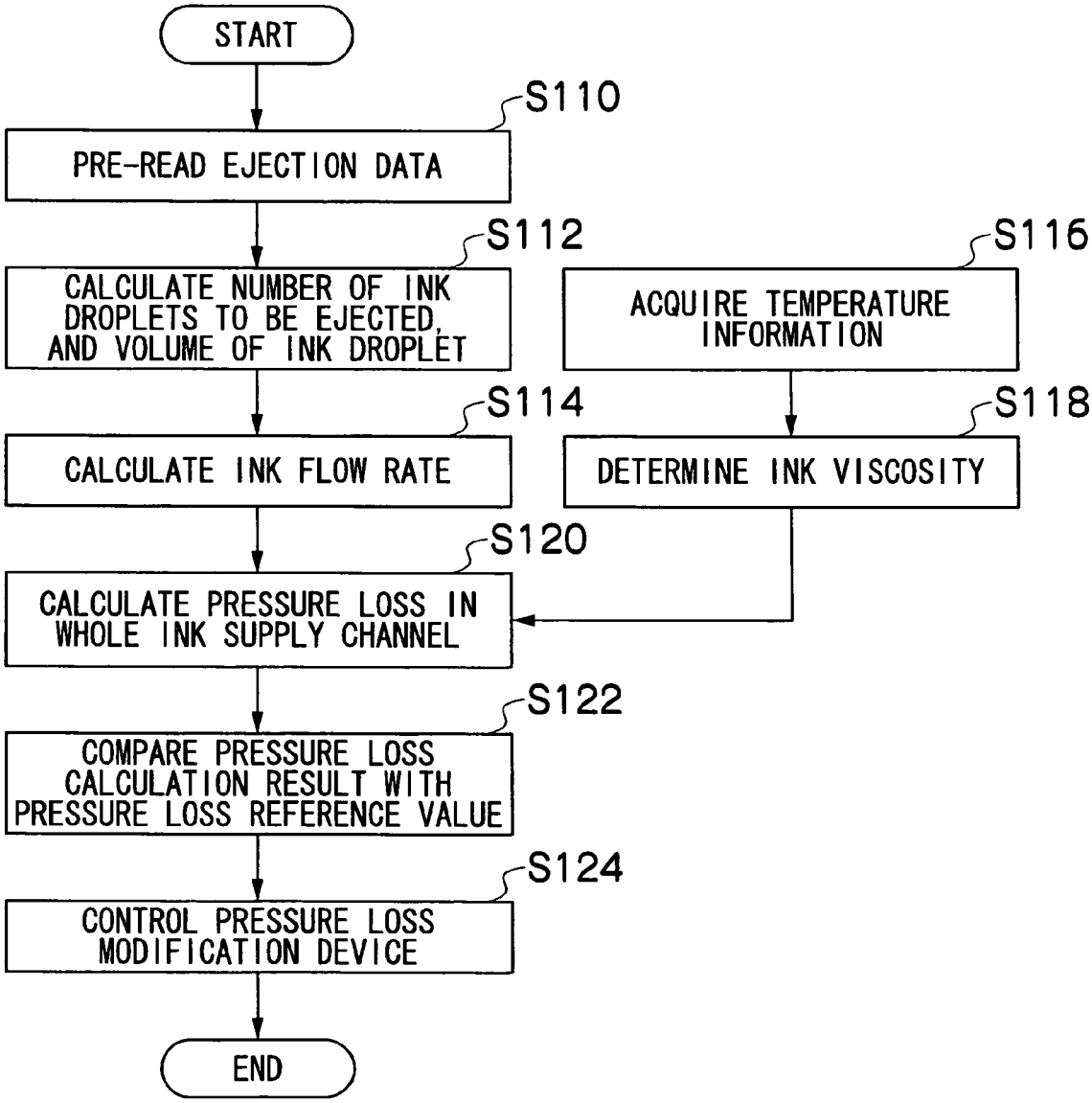
FIG. 4 is a flowchart showing a control procedure of the ink supply apparatus according to the first embodiment.

FIG. 4 is a flowchart showing a control procedure for the ink supply apparatus 10 having the composition described above. The operation of the ink supply apparatus 10 is described below with reference to the flowchart.

Firstly, ejection data for an image to be printed is read in by means of the ejection data pre-reading device 58 shown in FIG. 1 (step S110 in FIG. 4), and a number of ink droplets to be ejected during the prescribed time period Δt, and an ink volume per ejected droplet, are calculated on the basis of the ejection data thus read in (step S112).

From the information calculated at step S112, the ink volume consumed within the prescribed time period Δt (in other words, the ink supply volume that is to be supplied from the ink tank 12 to the print head 16 during the prescribed time period Δt) is calculated, and the ink flow rate Q per unit time period is calculated on the basis of this value (step S114).

On the other hand, information on the ink temperature is obtained from the temperature measurement device 54, at a suitable timing (step S116), and the ink viscosity is determined on the basis of this temperature information, from the correlation between the ink temperature and the ink viscosity (step S118).

Next, the overall pressure loss in the ink supply channel 14 is calculated from Formula (2), using the ink flow rate Q predicted at step S114, and the ink viscosity value determined at step S118 (step S120). The pressure loss value calculated at step S120 is compared with a previously stored pressure loss reference value (step S122), and the pressure loss modification device 20 is controlled on the basis of this comparison result, after the pre-reading time differential tp (the timing at which the ejection data pre-read at step S110 becomes printed), in such a manner that the overall pressure loss in the ink supply channel 14 matches the pressure loss reference value (step S124).

According to the present embodiment, the change in back pressure due to the flow resistance of the ink supply system during continuous ejection is predicted from the ejection data read in, and the pressure loss inside the ink supply channel 14 is adjusted on the basis of this prediction result by controlling the pressure loss modification device, in such a manner that the variation in back pressure is minimized by controlling the flow resistance so that the sum total (back pressure variation) in the whole ink supply channel 14 is substantially constant.

Accordingly, it is possible to control the pressure loss in real time, and the back pressure in the head can be maintained at a substantially constant value at all times (more precisely, it is kept within a prescribed range including a certain tolerance with respect to the control target value).

Instead of the calculation in step S112 or in addition to the calculation in step S112, it is possible to calculate the printing duty and to calculate the ink flow rate from the printing duty value thus obtained.

FIGS. 5 and 6 show examples of the numerical conditions in an actual apparatus. FIG. 5 shows an example of a case in which the ink viscosity changes at a constant ink flow rate, and FIG. 6 shows an example of a case in which the ink flow rate changes at a constant ink viscosity. In each of the examples, the apparatus conditions are as shown in the following (1) to (3):

(1) Head conditions: The liquid droplet volume per ejection is 2 picoliters (pl); the number of nozzles in the print head (namely, the number of nozzles which can perform ejection simultaneously) is 14031 nozzles; and the ejection frequency is 10 kHz.

(2) Ink conditions: 0.009 Pa·s (at 25° C.).

(3) The internal diameter of the elastic tube 30 in the pressure loss modification device 20 is 3 mm.

Moreover, the first flow channel section 14-1 has the length $L_1$=0.5 m and the diameter $d_1=5\times10^{-3}$ m, the second flow channel section 14-2 has the length $L_2$=0.1 and the diameter $d_2$ which is variable, and the third flow channel section 14-3 has the length $L_3$=0.1 m and the diameter $d_3=5\times10^{-3}$ m, which are explained with reference to FIG. 1.

In FIGS. 5 and 6, "flow channel A" is a flow channel section which includes (is formed by the sum of) the first flow channel section 14-1 and the third flow channel section 14-3 in FIG. 1. Furthermore, "flow channel B" in FIGS. 5 and 6 is the second flow channel section 14-2 described in FIG. 1. FIG. 5 shows the diameter (flow channel diameter) of the flow channel B which is varied in accordance with the change in the ink temperature (in other words, the change in the ink viscosity).

Furthermore, FIG. 6 shows the diameter (flow channel diameter) of the flow channel B which is varied in accordance with the change in the ink flow rate (in other words, the change in the ink printing duty). At full duty printing (100%), the ink flow rate Q per unit time period is calculated as Q="liquid droplet volume"×"number of nozzle"×"ejection frequency", and in the case of the apparatus conditions described above, $Q=2\times10^{-15}\times14031\times10^{4}=2.81\times10^{-7}$ ($m^3/s$).

Second Embodiment

FIG. 7 is a block diagram showing the general composition of an ink supply apparatus in an inkjet recording apparatus according to a second embodiment of the present invention. In FIG. 7, elements which are the same as or similar to the compositional embodiment in FIG. 1 are denoted with the same reference numerals and description thereof is omitted here.

FIG. 1 shows the embodiment of the mechanism for changing the flow channel diameter, which acts as the pressure loss modification device 20 (see FIGS. 2A and 2B). On the other hand, in the ink supply apparatus 70 shown in FIG. 7, a heating device 72 is provided in a portion of the ink supply channel 14, as a device for changing the pressure loss in the ink supply channel 14. In other words, the ink supply apparatus 70 in FIG. 7 changes the ink viscosity as a control factor which governs the pressure loss in the ink supply channel 14 (namely, it controls the ink viscosity by means of temperature control, on the basis of the correlation between the ink viscosity and temperature shown in FIG. 3). The second embodiment shown in FIG. 7 is an effective mode for a system which uses high-viscosity ink, in particular.

As shown in FIG. 7, in the ink supply apparatus 70, in order to ascertain the ink temperature inside the ink supply channel 14, a plurality of temperature measurement devices 76, 77 and 78 are provided along the flow path of the ink supply channel 14. In FIG. 7, in order to simplify the description, an embodiment is described in which the ink supply channel 14 is divided into four regions (14-1 to 14-4), but there are no particular restrictions of the method of dividing the flow channel (the number of sections and the length of each section).

In FIG. 7, the tube channel from the end of the tube 22 inserted in the ink tank 12 until the upstream end of the heating device 72 is taken to be the first flow channel section 14-1, the tube channel section in the region where the heating device 72 is provided is taken to be the second flow channel section 14-2, the first half section (tube 24A) of the flow channel from the downstream end of the heating device 72 toward the print head 18 is taken to be the third flow channel section 14-3, and the second half section thereof (in other words, the tube 24B from the downstream end of the third flow channel section 14-3 until the inlet to the print head 16) is taken to be the fourth flow channel section 14-4.

The temperature measurement devices 76, 77 and 78 are provided so as to correspond to the respective flow channel sections of the second flow channel section 14-2, the third flow channel section 14-3 and the fourth flow channel section 14-4, and the ink temperature inside the respective flow channel sections 14-2, 14-3 and 14-4 is measured by means of these temperature measurement devices 76, 77 and 78. With respect to the ink temperature inside the first flow channel section 14-1, the temperature information from the temperature measurement device 54 provided in the ink tank 12 is used. The temperature information (temperature measurement signals) obtained from the temperature measurement devices 54, 76, 77 and 78 are supplied to the viscosity determination device 56, where they are used to determine (estimate) the viscosity of the ink.

In the case of the composition shown in FIG. 7, the overall pressure loss $-\Delta P$ of the ink supply channel 14 is expressed in the following Formula (3), as the sum total of the pressure losses in the flow channel sections 14-1 to 14-4:

$$-\Delta P=(128Q/\pi)\times\{(L_1\mu_1/d_1^4)+(L_2\mu_2/d_2^4)+(L_3\mu_3/d_3^4)+(L_4\mu_4/d_4^4)\}, \quad (3)$$

where $\mu_j$ (j=1, 2, 3, 4) is the ink viscosity inside the j-th flow channel section **14-*j*, $d_j$ is the equivalent diameter of the j-th flow channel section 14-*j*, and $L_j$ is the tube channel length of the j-th flow channel section 14-*j*. Here, the equivalent diameter $d_j$ and the tube channel length $L_j$ of each flow channel section 14-*j* are fixed values which are intrinsic to the apparatus (parameters dependent on the dimensions and shape of the apparatus), and the control factor which governs the pressure loss is the ink viscosity $\mu_2$ in the second flow channel section 14-2. If the ink inside the second flow channel section 14-2 is heated by the heating device 72, then due to the movement of ink inside the flow channel, ultimately, the ink temperature in the third flow channel section 14-3 and the fourth flow channel section 14-4 on the downstream side thereof is change, thereby causing the ink viscosity values $\mu_3$ and $\mu_4$ to change also. In other words, the pressure loss in the region downstream of the heating device 72** is changed.

The ink viscosity $\mu_1$ inside the first flow channel section 14-1 is estimated on the basis of the temperature $T_1$ measured by the temperature measurement device 54 ($\mu_1=f(T_1)$, see FIG. 3). Similarly, the ink viscosity $\mu_2$ inside the second flow channel section 14-2 is estimated on the basis of the temperature $T_2$ measured by the temperature measurement device 76, the ink viscosity $\mu_3$ inside the third flow channel section 14-3 is estimated on the basis of the temperature $T_3$ measured by the temperature measurement device 77, and the ink viscosity $\mu_4$ inside the fourth flow channel section 14-4 is estimated on the basis of the temperature $T_4$ measured by the temperature measurement device 78.

In the ink supply apparatus 70 shown in FIG. 7, the temperature $T_2$ (in other words, the ink viscosity $\mu_2$) is controlled and altered by controlling the heating device 72, in such a manner that the pressure loss $\Delta P$ calculated by Formula (3) becomes the pressure loss reference value $\Delta P_0$.

Furthermore, a heating device 80 for heating and controlling the ink temperature inside the head is provided in the print head 16. The heating devices 72 and 80 include heaters capable of switching heating on and off by electrical control, by passing or not passing current, for instance (and more particularly, heaters in which the heating temperature can be controlled).

The ink temperature inside the print head 16 is controlled by the heating device 80 provided inside the print head 16, so as to remain at a constant temperature which is higher than the ink temperature inside the ink supply channel 14. In other words, the heating device 80 controls the ink temperature inside the print head 16 in such a manner that it is a constant temperature $T_5$ (where $T_5>T_4$). Accordingly, it is possible to avoid temperature variations inside the print head 16 due to external disturbances of the heating device 72 in the ink supply channel 14.

It is also possible to provide a temperature measurement device (not shown) for measuring the ink temperature inside the print head 16, thereby monitoring the temperature in the head and controlling the heating device 80 on the basis of the temperature information thus obtained, in such a manner that the ink temperature becomes a substantially constant temperature $T_5$ (in practice, within a certain temperature tolerance range), or it is possible to control the heating device 80 by time managing using a timer or the like.

The control device 66 functions as a control device which controls the driving of the heating devices 72 and 80, and hence the on and off switching, and the heating temperature, of the heating devices 72 and 80 are controlled by means of control signals (heating control signals) outputted by the control device 66.

Figure 8:
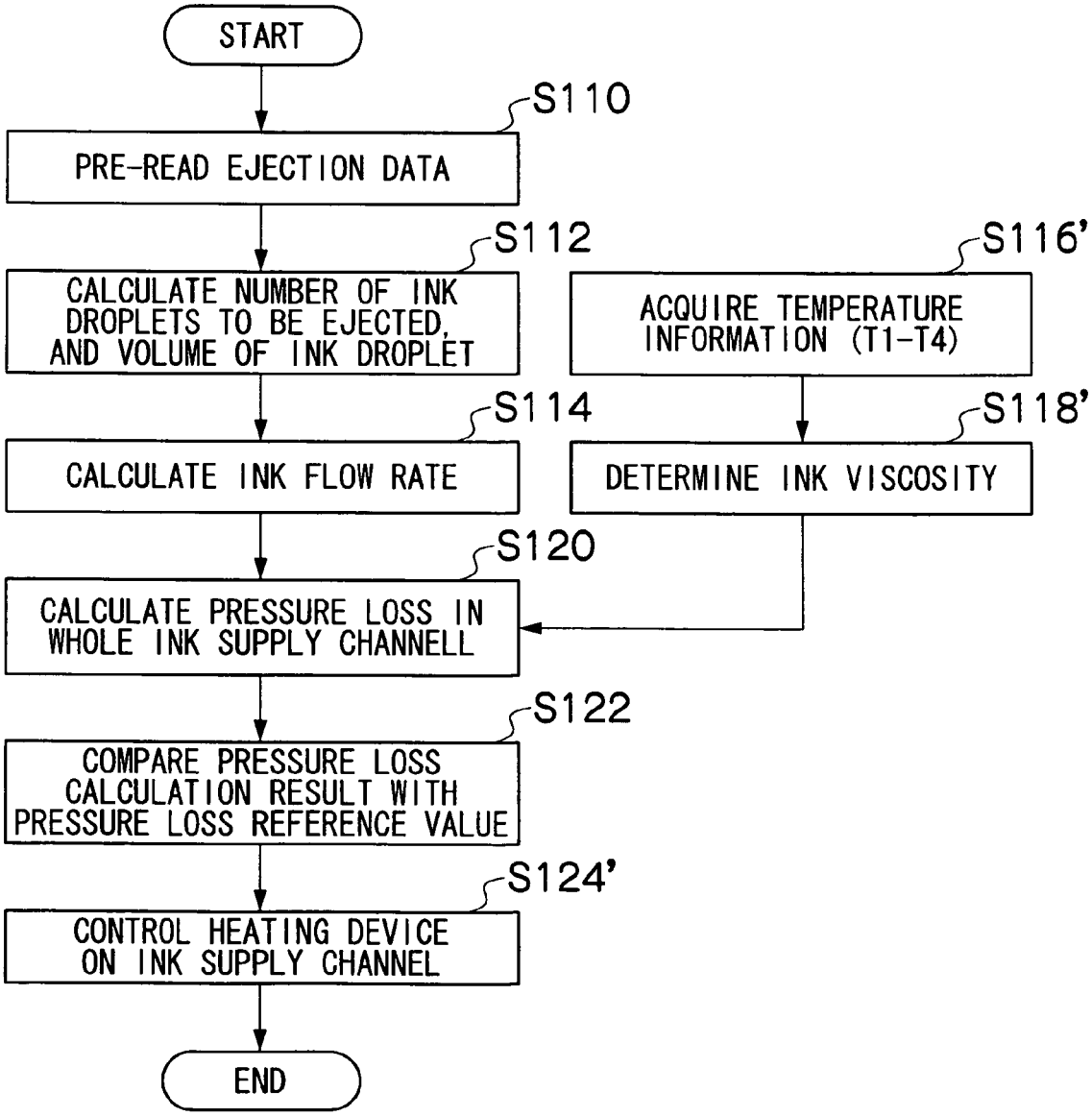
FIG. 8 is a flowchart showing a control procedure of the ink supply apparatus according to the second embodiment.

FIG. 8 is a flowchart showing a control procedure for the ink supply apparatus 70 having the composition described above. The operation of the ink supply apparatus 70 is described below with reference to the flowchart. In FIG. 8, steps which are the same as or similar to those in the flowchart in FIG. 4 are denoted with the same step number and description thereof is omitted here. The steps S116, S118 and S124 shown in FIG. 4 are substituted respectively with step S116', step S118' and step S124' in FIG. 8.

More specifically, in step S116' in FIG. 8, the ink temperature information ($T_1$ to $T_4$) is acquired respectively from the temperature measurement devices 54, 76, 77 and 78, at suitable timings. The ink viscosity values in the respective flow channels sections (14-1 to 14-4) are estimated from these temperature information values ($T_1$ to $T_4$), on the basis of the correlation between the ink temperature and ink viscosity shown in FIG. 3 (step S118').

Next, the overall pressure loss in the ink supply channel 14 is calculated from Formula (3), using the ink flow rate Q predicted at step S114, and the ink viscosity values determined at step S118' (step S120). The pressure loss value calculated at step S120 is compared with a previously stored pressure loss reference value (step S122), and the heating device 72 is controlled on the basis of this comparison result, after a suitable time differential which takes account of the pre-reading time differential tp and the response of the heating control (a timing whereby the ink reaches a prescribed temperature at the time when the ejection data read in at step S110 becomes printed), in such a manner that the overall pressure loss in the ink supply channel 14 matches the pressure loss reference value (step S124').

Accordingly, it is possible to control the pressure loss in real time, and the back pressure in the head can be maintained at a substantially constant value at all times (more precisely, it is kept within a prescribed range including a certain tolerance with respect to the control target value).

In FIG. 7, the temperature measurement devices 77 and 78 are provided respectively in the third flow channel section 14-3 and the fourth flow channel section 14-4, but in calculating the pressure loss ΔP, it is also possible to pre-read the ejection data, and to then estimate the temperatures $T_3$ and $T_4$ by taking account of the movement of the liquid inside the flow channel after a unit time period. In this case, calculation formulas (programs), tables, and the like are required for estimating the temperatures $T_3$ and $T_4$, but in terms of the device composition, it becomes possible to omit the temperature measurement devices 77 and 78.

Furthermore, a mode is also possible in which the pressure loss is controlled by conjoint use of the device that changes the diameter of the flow channel as described in the first embodiment, and the device (heating device) that changes the ink temperature as described in the second embodiment. In this case, both the equivalent diameter $d_2$ and the temperature $T_2$ of the second flow channel section 14-2 described in FIG. 7 are controlled. Since the response of the temperature control is slower than the control of the flow channel diameter (aperture control), it is possible to achieve a broader range of control by combining the use of these methods.

Embodiment of Composition of Inkjet Recording Apparatus

Next, an embodiment of the composition of an inkjet recording apparatus which uses the ink supply apparatus described in the first embodiment or the second embodiment above is explained.

Figure 9:
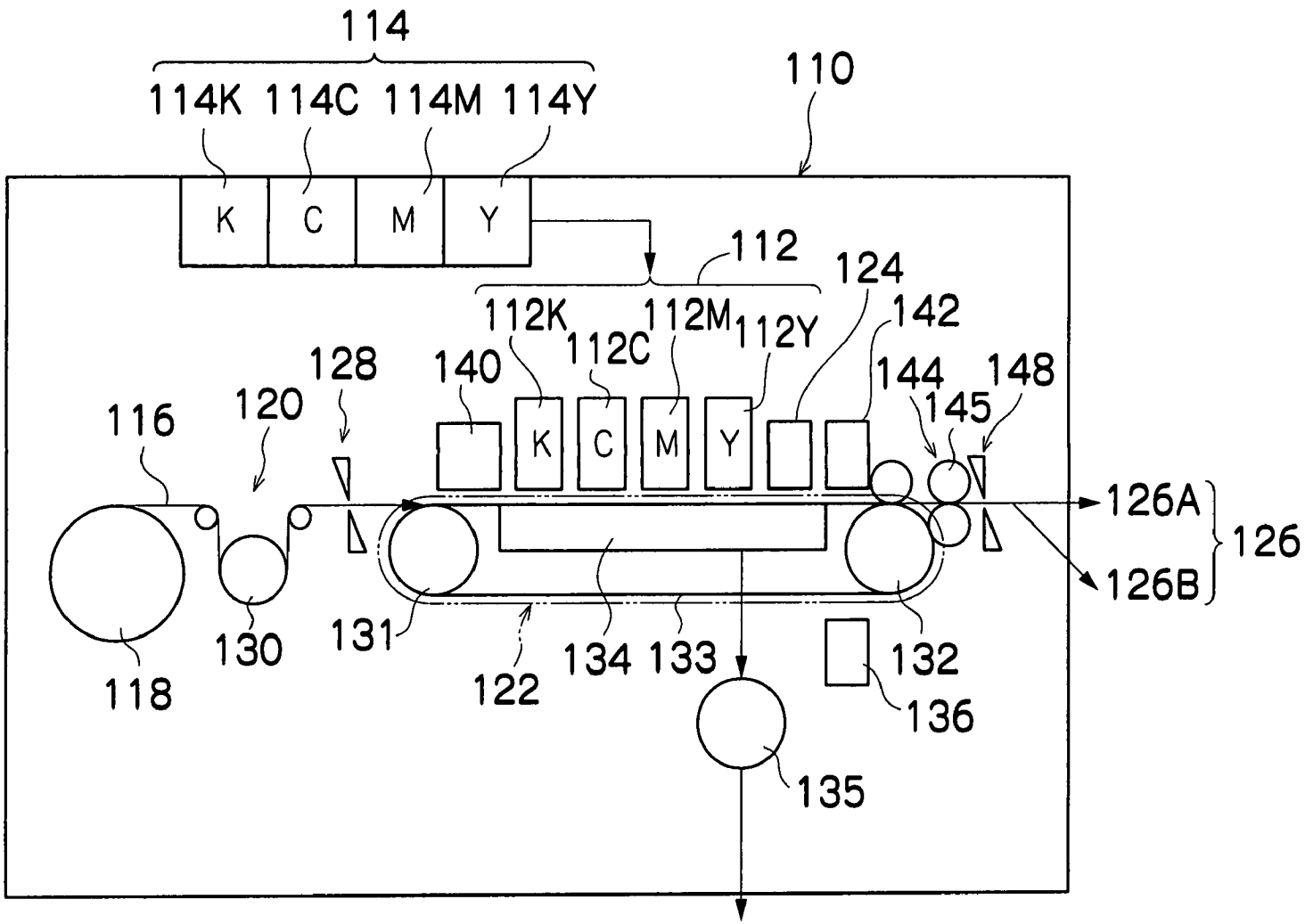
FIG. 9 is a general schematic drawing of an inkjet recording apparatus according to an embodiment of the present invention.

FIG. 9 is a diagram of the general composition of an inkjet recording apparatus according to one embodiment of the present invention. As shown in FIG. 9, the inkjet recording apparatus 110 comprises: a print unit 112 having a plurality of print heads 112K, 112C, 112M, and 112Y provided for ink colors of black (K), cyan (C), magenta (M), and yellow (Y), respectively; an ink storing and loading unit 114 for storing inks to be supplied to the print heads 112K, 112C, 112M and 112Y; a paper supply unit 118 for supplying recording paper 116 forming a recording medium; a decurling unit 120 for removing curl in the recording paper 116; a belt conveyance unit 122, disposed facing the nozzle face (ink ejection face) of the print unit 112, for conveying the recording paper 116 while keeping the recording paper 116 flat; a print determination unit 124 for reading the printed result produced by the print unit 112; and a paper output unit 126 for outputting recorded recording paper (printed matter) to the exterior.

The print heads 112K, 112C, 112M and 112Y correspond to the print head 16 shown in FIG. 1 and FIG. 7, and the ink storing and loading unit 114 in FIG. 9 corresponds to the ink tank 12 shown in FIG. 1 and FIG. 7.

In other words, the ink storing and loading unit 114 shown in FIG. 9 has ink tanks 114K, 114C, 114M and 114Y for storing inks of colors corresponding to the respective print heads 112K, 112C, 112M and 112Y. The ink tanks 114K, 114C, 114M and ll4Y each have a similar composition to that of the ink tank 12 shown in FIG. 1, and are respectively connected to the print head 112K, 112C, 112M and 112Y of the corresponding colors, through prescribed tubes (corresponding to the ink supply channel 14 shown in FIG. 1 and FIG. 7).

The ink storing and loading unit 114 has a warning device (for example, a display device or an alarm sound generator) for warning when the remaining amount of any ink is low, and has a mechanism for preventing loading errors among the colors.

In FIG. 9, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (medium) can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 9, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 9. The suction chamber 134 provides suction with a fan 135 to generate a negative pressure, and the recording paper 116 is held on the belt 133 by suction. It is also possible to use an electrostatic attraction method, instead of a suction-based attraction method.

The belt 133 is driven in the clockwise direction in FIG. 9 by the motive force of a motor 188 (shown in FIG. 14) being transmitted to at least one of the rollers 131 and 132, which the belt 133 is set around, and the recording paper 116 held on the belt 133 is conveyed from left to right in FIG. 9.

Since ink adheres to the belt 133 when a marginless print job or the like is performed, a belt cleaning unit 136 is disposed in a predetermined position (a suitable position outside the printing area) on the exterior side of the belt 133. Although the details of the configuration of the belt cleaning unit 136 are not shown, embodiments thereof include a configuration in which the belt 133 is nipped with a cleaning roller such as a brush roller and a water absorbent roller, an air blow configuration in which clean air is blown onto the belt 133, or a combination of these. In the case of the configuration in which the belt 133 is nipped with the cleaning roller, it is preferable to make the linear velocity of the cleaning roller different to that of the belt 133, in order to improve the cleaning effect.

Instead of the belt conveyance unit 122, it might also be possible to use a roller nip conveyance mechanism, but since the print region passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 140 is provided on the upstream side of the print unit 112 in the paper conveyance path formed by the belt conveyance unit 122. This heating fan 140 blows heated air onto the recording paper 116 before printing, and thereby heats up the recording paper 116. Heating the recording paper 116 before printing means that the ink will dry more readily after landing on the paper.

Figure 10:
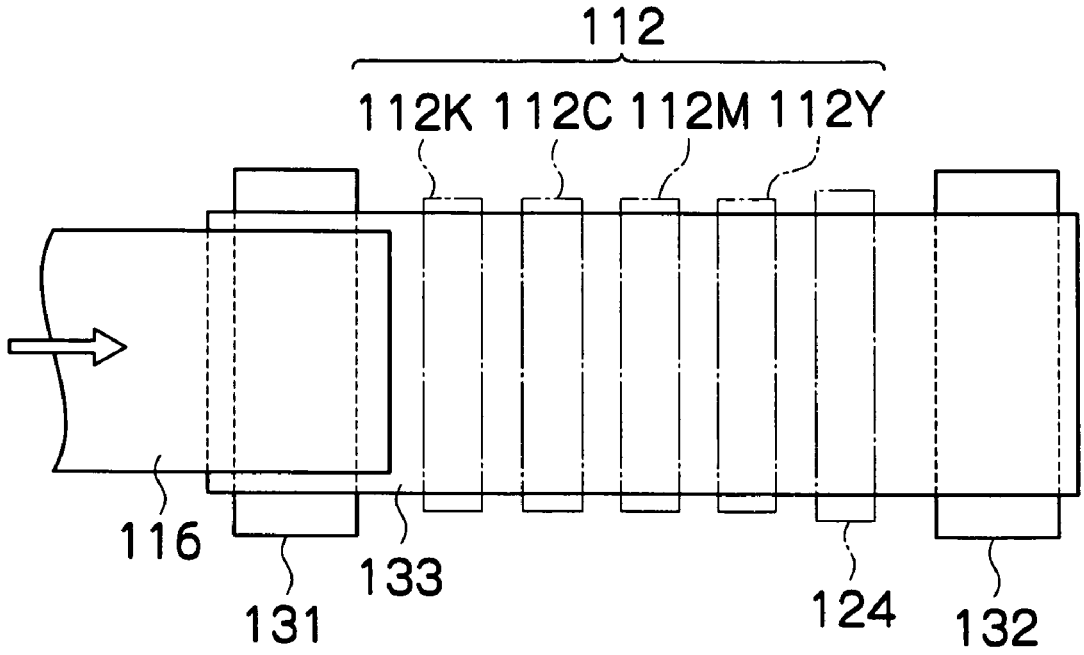
FIG. 10 is a principal plan diagram of the peripheral area of a print unit in the inkjet recording apparatus shown in FIG. 9.

The print heads 112K, 112C, 112M and 112Y of the print unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 10).

The print heads 112K, 112C, 112M, and 112Y are arranged in color order (black (K), cyan (C), magenta (M), yellow (Y)) from the upstream side in the delivery direction of the recording paper 116, and these respective print heads 112K, 112M, 112C and 112Y are fixed extending in a direction substantially perpendicular to the conveyance direction of the recording paper 116.

A color image can be formed on the recording paper 116 by ejecting inks of different colors from the print heads 112K, 112C, 112M and 112Y, respectively, onto the recording paper 116 while the recording paper 116 is conveyed by the belt conveyance unit 122.

By adopting a configuration in which full line print heads 112K, 112C, 112M and 112Y having nozzle rows covering the full paper width are provided for each separate color in this way, it is possible to record an image on the full surface of the recording paper 116 by performing just one operation of moving the recording paper 116 and the print unit 112, relatively, in the paper conveyance direction (the sub-scanning direction), (in other words, by means of one sub-scanning action). Higher-speed printing is thereby made possible and productivity can be improved in comparison with a shuttle type head configuration in which a print head moves back and forth reciprocally in the main scanning direction.

Although a configuration with the KMCY four standard colors is described in the present embodiment, the combinations of the ink colors and the number of colors are not limited to these. Light and/or dark inks, and special color inks can be added as required. For example, a configuration is possible in which print heads for ejecting light-colored inks such as light cyan and light magenta are added. Furthermore, there are no particular restrictions on the sequence in which the heads of respective colors are arranged.

The print determination unit 124 shown in FIG. 10 has an image sensor (line sensor or area sensor) for capturing an image of the droplet ejection result of the print unit 112, and functions as a device to check for ejection defects such as blockages, landing position displacement, and the like, of the nozzles from the image of ejected droplets read in by the image sensor. A test pattern or the target image printed by the print heads 112K, 112C, 112M, and 112Y of the respective colors is read in by the print determination unit 124, and the ejection performed by each head is determined. The ejection determination includes the presence of the ejection, measurement of the dot size, and measurement of the dot landing position. This print determination unit 124 may also serve as a device which measures the optical density of a droplet ejection sample.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 10, the paper output unit 126A for the target prints is provided with a sorter for collecting prints according to print orders.

Structure of Print Head

Next, the structure of the print head is described. The print heads 112K, 112C, 112M and 112Y for the respective ink colors have the same structure, and a reference numeral 150 is hereinafter designated to any of the print heads.

Figure 11A:
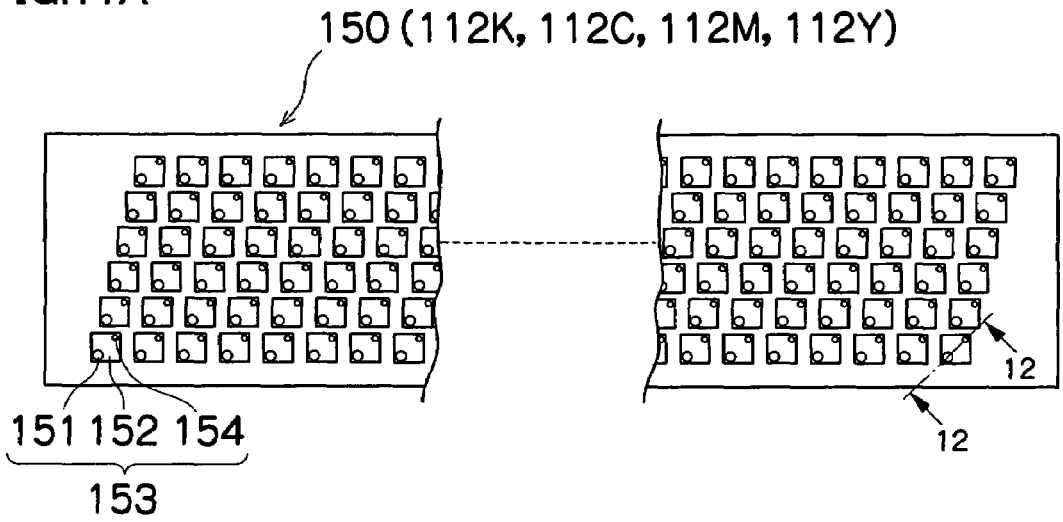
FIG. 11A is a plan view perspective diagram showing the internal structure of the composition of a print head.
Figure 11B:
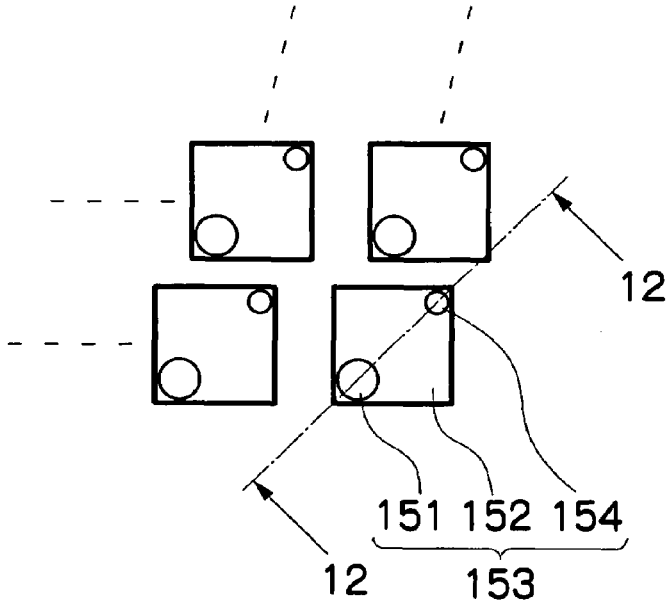
FIG. 11B is a principal enlarged view of FIG. 11A.
Figure 11C:
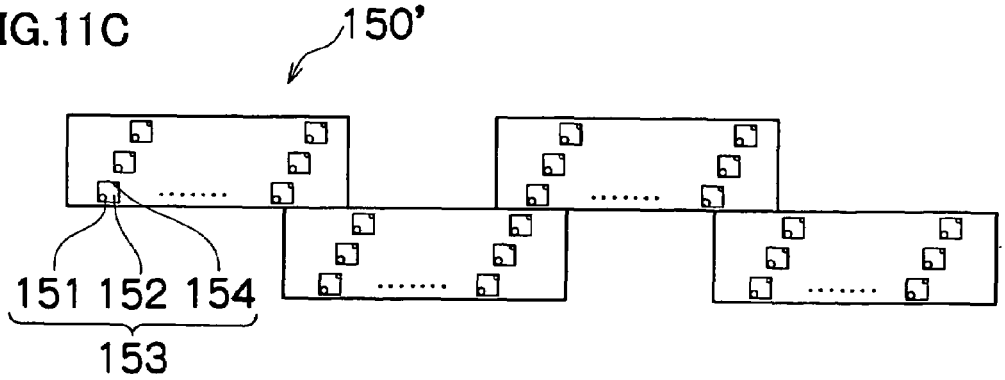
FIG. 11C is a plan view perspective diagram showing a further embodiment of the composition of a full line head.
Figure 12:
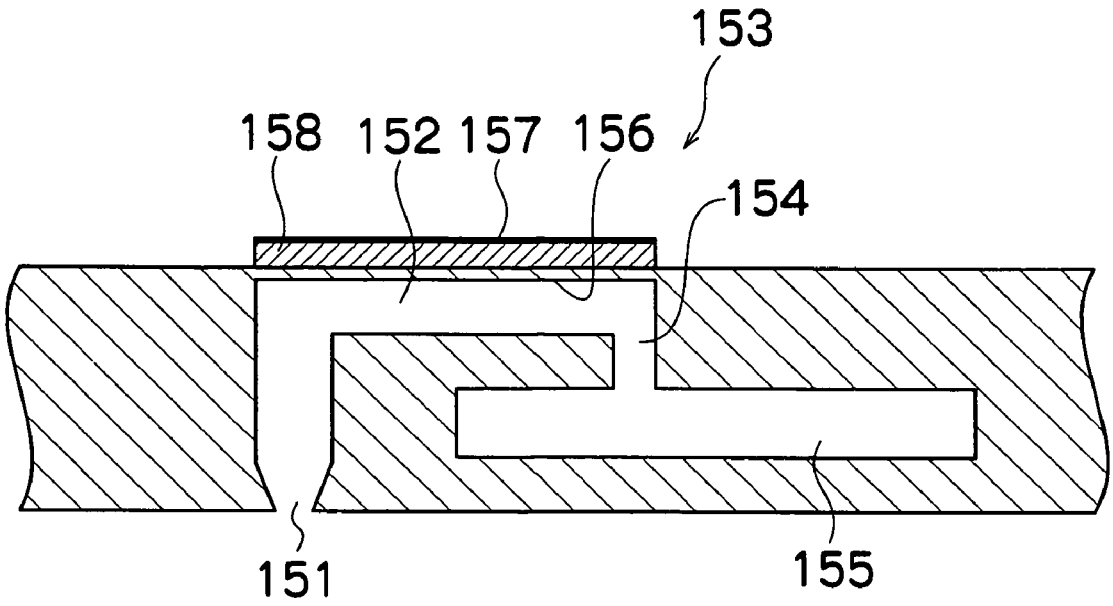
FIG. 12 is a cross-sectional view along line 12-12 in FIG. 11A.

FIG. 11A is a perspective plan view showing an embodiment of the configuration of the print head 150, FIG. 11B is an enlarged view of a portion thereof, FIG. 11C is a perspective plan view showing another embodiment of the configuration of the print head 150, and FIG. 12 is a cross-sectional view taken along line 12-12 in FIG. 11A, showing the inner structure of a droplet ejection element (an ink chamber unit for one nozzle 151).

The nozzle pitch in the print head 150 should be minimized in order to maximize the resolution of the dots printed on the surface of the recording paper 116. As shown in FIGS. 11A and 11B, the print head 150 according to the present embodiment has a structure in which a plurality of ink chamber units (droplet ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the embodiment described above. For example, instead of the configuration in FIG. 11A, as shown in FIG. 11C, a line head having nozzle rows of a length corresponding to the entire width of the recording paper 116 can be formed by arranging and combining, in a staggered matrix, short head modules 150' having a plurality of nozzles 151 arrayed in a two-dimensional fashion.

As shown in FIGS. 11A and 11B, the planar shape of the pressure chamber 152 provided corresponding to each nozzle 151 is substantially a square shape, and an outlet port to the nozzle 151 is provided at one of the ends of the diagonal line of the planar shape, while an inlet port (supply port) 154 for supplying ink is provided at the other end thereof. The shape of the pressure chamber 152 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 12, each pressure chamber 152 is connected to a common channel 155 through the supply port 154. The common channel 155 is connected to the ink tank (not shown in FIG. 12), which is a base tank that supplies ink, and the ink supplied from the ink tank is delivered through the common flow channel 155 to the pressure chambers 152.

An actuator 158 provided with an individual electrode 157 is bonded to a pressure plate (a diaphragm that also serves as a common electrode) 156 which forms the surface of one portion (in FIG. 12, the ceiling) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuator 158, it is possible to use a piezoelectric element using a piezoelectric body, such as lead zirconate titanate, barium titanate, or the like. When the displacement of the actuator 158 returns to its original position after ejecting ink, new ink is supplied to the pressure chamber 152 from the common liquid chamber 155, through the supply port 154.

Figure 13:
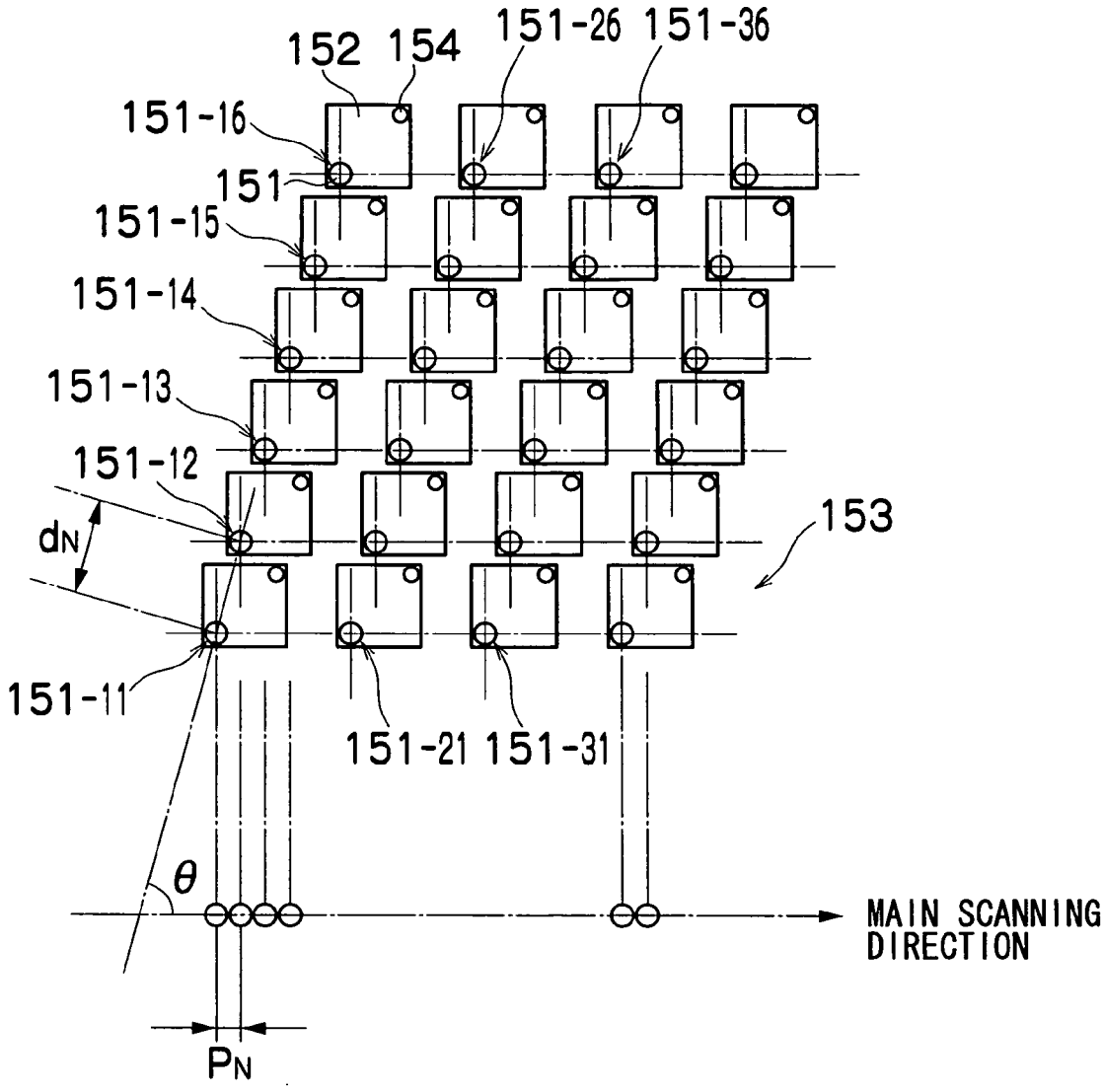
FIG. 13 is an enlarged view showing a nozzle arrangement in the print head shown in FIG. 11A.

As shown in FIG. 13, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch $d_N$ in line with a direction forming an angle of θ with respect to the main scanning direction, the pitch $P_N$ 891 of the nozzles projected so as to align in the main scanning direction is $d_N \times \cos\theta$, and hence the nozzles 151 can be regarded to be equivalent to those arranged linearly at a fixed pitch $P_N$ along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 13 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

In implementing the present invention, the arrangement of the nozzles is not limited to that of the embodiment illustrated. Moreover, a method is employed in the present embodiment where an ink droplet is ejected by means of the deformation of the actuator 158, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 14:
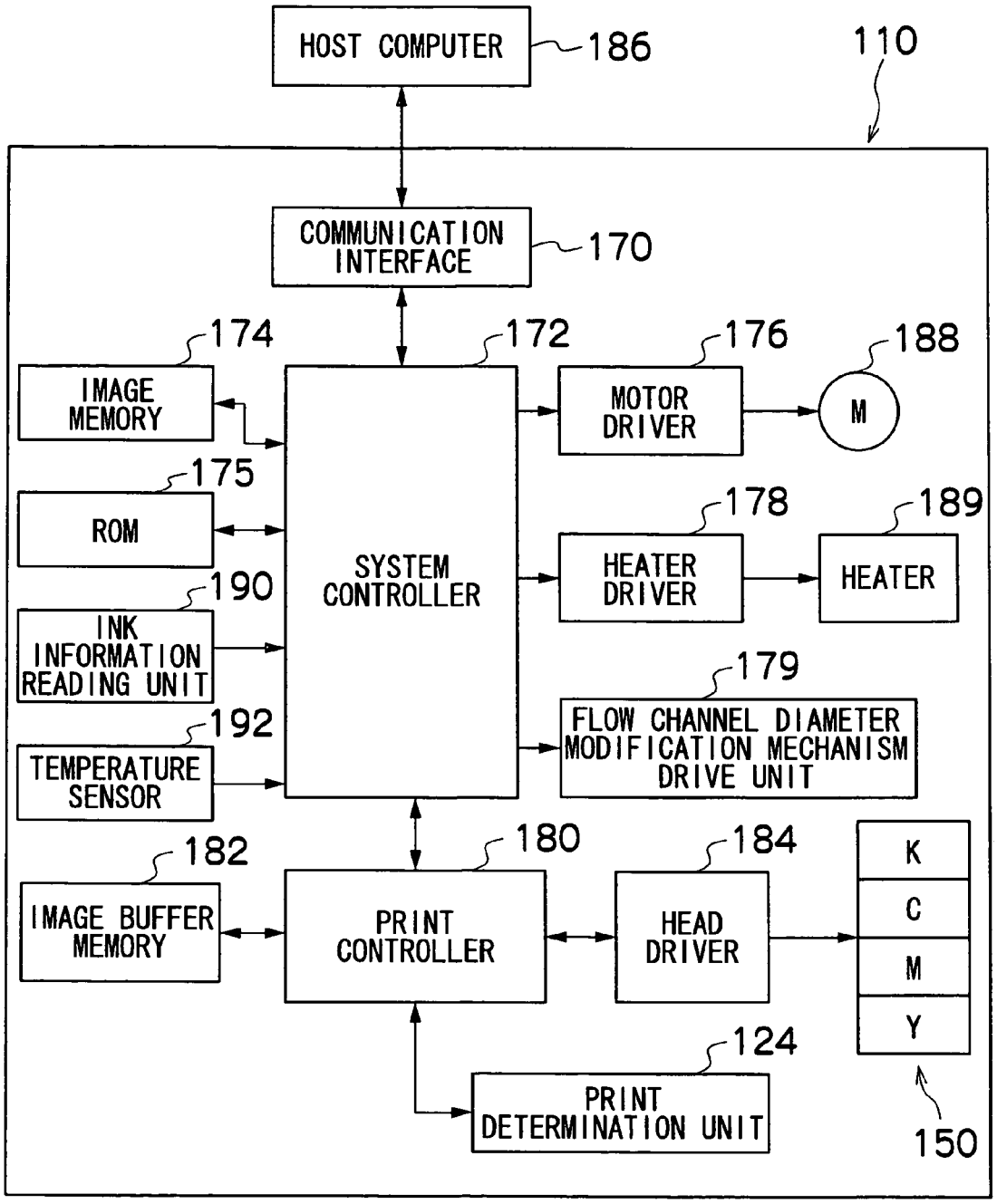
FIG. 14 is a principal block diagram showing the system composition of an inkjet recording apparatus using the ink supply apparatus according to the first embodiment.

FIG. 14 is a block diagram showing an embodiment of the system composition of the inkjet recording apparatus 110. The composition shown in FIG. 14 is an embodiment of a case using the pressure loss modification device 20 of the type which changes the diameter of the flow channel as shown in FIG. 1. As shown in FIG. 14, the inkjet recording apparatus 110 comprises: a communication interface 170, a system controller 172, an image memory 174, a ROM 175, a motor driver 176, a heater driver 178, a flow channel diameter modification mechanism drive unit 179, a print controller 180, an image buffer memory 182, a head driver 184, and the like.

The communication interface 170 is an interface unit (image input device) for receiving image data sent from a host computer 186. A serial interface such as USB, IEEE 1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and the ROM 175, and it also generates control signals for controlling the motor 188 and heater 189 of the conveyance system.

Furthermore, the system controller 172 generates a control signal for controlling the flow channel diameter modification mechanism drive unit 179. The flow channel diameter modification mechanism drive unit 179 is a block comprising the motor 42 and the motor driver 48 for driving the flow channel diameter modification mechanism shown in FIGS. 2A and 2B.

The program executed by the CPU of the system controller 172 and the various types of data which are required for control procedures are stored in the ROM 175 shown in FIG. 14. The ROM 175 may be a non-writeable storage device, or it may be a rewriteable storage device, such as an EEPROM. The image memory 174 is used as a temporary storage region for the image data, and it is also used as a program development region and a calculation work region for the CPU. Furthermore, the ROM 175 corresponds to the pressure loss reference value storage device 64 shown in FIG. 1.

As shown in FIG. 14, the inkjet recording apparatus 110 comprises an ink information gathering unit 190 and a temperature sensor 192. The ink information reading unit 190 is a device which acquires information relating to the ink used (ink type information). More specifically, it is possible to use, for example, a device which reads in ink properties information from the shape of the cartridge in the ink tank (a specific shape which allows the ink type to be identified), or from a bar code or IC chip incorporated into the cartridge. Besides this, it is also possible for an operator to input the required information by means of a user interface.

The temperature sensor 192 corresponds to the temperature measurement device 54 shown in FIG. 1. The information obtained by the ink information reading unit 190 and the temperature sensor 192 shown in FIG. 14 is reported to the system controller 172 and/or the print controller 180, and it is used to determine the ink viscosity, calculate the pressure loss in the ink supply channel 14, control the flow channel diameter modification drive unit 179, control the ink droplet ejection timing, and the like. More specifically, the system controller 172 functions as the viscosity determination device 56, the ejection data pre-reading device 58, the flow rate calculation device 60, the pressure loss calculation device 62 and the control device 66 shown in FIG. 1.

The motor driver 176 shown in FIG. 14 is a driver (drive circuit) which drives the motor 188 of the conveyance system in accordance with instructions from the system controller 172. The heater driver 178 drives the heater 189 of the post-drying unit 142 or the like in accordance with commands from the system controller 172.

The print controller 180 is a control unit having a signal processing function for performing various treatment processes, corrections, and the like, in accordance with the control implemented by the system controller 172, in order to generate a signal for controlling printing, from the image data (multiple-value input image data) in the image memory 174, and it supplies the ejection data (dot data) thus generated to the head driver 184.

The image buffer memory 182 is provided in the print controller 180, and image data, parameters, and other data are temporarily stored in the image buffer memory 182 when image data is processed in the print controller 180. FIG. 14 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is input from an external source through a communications interface 170, and is accumulated in the image memory 174. At this stage, RGB image data is stored in the image memory 174, for example.

In this inkjet recording apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y. In this way, the dot data generated by the print controller 180 is stored in the image buffer memory 182. This dot data of the respective colors is converted into CMYK droplet ejection data for ejecting ink from the nozzles of the print head 150, thereby establishing the ink ejection data to be printed.

The head driver 184 outputs drive signals for driving the actuators 158 corresponding to the respective nozzles 151 of the print head 150, on the basis of the ejection data supplied by the print controller 180 (in other words, the dot data stored in the image buffer memory 182, or the CMYK droplet ejection data or ink ejection data to be printed). A feedback control system for maintaining constant drive conditions in the head may be included in the head driver 184.

By supplying the drive signals output by the head driver 184 to the print head 150, ink is ejected from the corresponding nozzles 151. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled through the head driver 184, on the basis of the dot data generated by implementing prescribed signal processing in the print controller 180. By this means, prescribed dot size and dot positions can be achieved.

Furthermore, since the pressure loss in the ink supply channel 14 is estimated by predicting the ink flow rate from the ejection data, and the flow channel diameter modification mechanism drive unit 179 is controlled on the basis of a comparison between the calculation result for the pressure loss and the pressure loss reference value, in such a manner that the pressure loss during printing matches the pressure loss reference value, then it is possible to achieve stable ejection characteristics in accordance with change in the print conditions.

As shown in FIG. 9, the print determination unit 124 is a block including an image sensor, which reads in the image printed onto the recording medium 116, performs various signal processing operations, and the like, and determines the print situation (presence/absence of ejection, variation in droplet ejection, optical density, and the like), these determination results being supplied to the print controller 180. Instead of or in conjunction with this print determination unit 124, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each pressure chamber 152 of the print head 150, and ejection abnormalities are detected from the determination signals obtained from these pressure sensors when ink is ejected or when the actuators are driven in order to measure the pressure. Alternatively, it is also possible to adopt a mode (external determination method) using an optical determination system comprising a light source, such as laser light emitting element, and a photoreceptor element, whereby light, such as laser light, is irradiated onto the ink droplets ejected from the nozzles and the droplets in flight are determined by means of the transmitted light quantity (received light quantity).

The print controller 180 implements various corrections with respect to the print head 150, on the basis of the information obtained from the print determination unit 124 or another ejection determination device (not shown), according to requirements, and it implements control for carrying out cleaning operations (nozzle restoring operations), such as preliminary ejection, suctioning, or wiping, as and when necessary.

Figure 15:
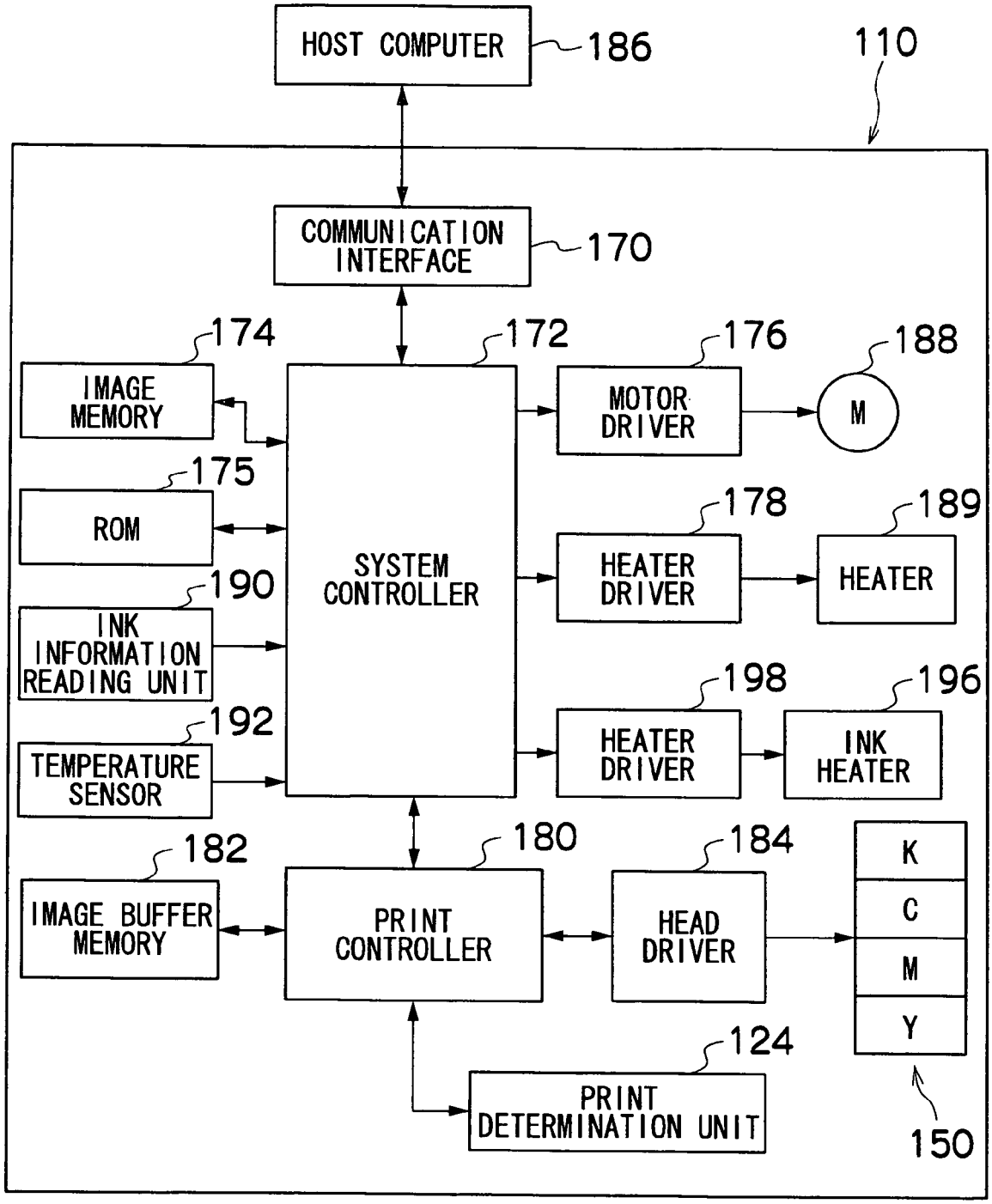
FIG. 15 is a principal block diagram showing the system composition of an inkjet recording apparatus using the ink supply apparatus according to the second embodiment.

FIG. 15 is a block diagram showing a further embodiment of the system composition of the inkjet recording apparatus 110 shown in FIG. 9. The composition shown in FIG. 15 is an embodiment of the mode where the ink viscosity is controlled and varied by means of the heating device 72 as shown in FIG. 7. In FIG. 15, elements which are the same as or similar to the composition in FIG. 14 are denoted with the same reference numerals and description thereof is omitted here.

Instead of the flow channel diameter modification mechanism drive unit 179 shown in FIG. 14, an ink heater 196 forming the pressure loss modification device, and a heater driver 198 for driving same, are provided in FIG. 15. The ink heater 196 corresponds to the heating device 72 shown in FIG. 7. Furthermore, the temperature sensor 192 in FIG. 15 corresponds to the temperature measurement devices 54, 76, 77 and 78 shown in FIG. 7, and for the sake of convenience, it is depicted as a single block in FIG. 15.

According to the composition shown in FIG. 15, the system controller 172 estimates the pressure loss in the ink supply channel 14 by estimating the ink viscosity on the basis of the temperature information obtained from the temperature sensor 192, and by predicting the ink flow rate from the ejection data. The system controller 172 then controls, on the basis of a comparison between the estimated pressure loss and the pressure loss reference value, the driving of the ink heater 196 in such a manner that the pressure loss during printing coincides with the pressure loss reference value. Accordingly, stable ejection characteristics are obtained in response to change in the print situation.

The above-described embodiments relate to the inkjet recording apparatus and the ink supply apparatus used in same, but the scope of application of the liquid supply apparatus according to the present invention is not limited to this. For example, the liquid supply apparatus according to the present invention may also be applied to a photographic image forming apparatus in which developing solution is applied to a printing paper by means of a non-contact method. Furthermore, the implementation of the liquid supply apparatus according to the present invention is not limited to an image forming apparatus, and the present invention may also be applied to various other types of apparatuses which ejects a processing liquid, chemical solution, or other type of liquid, toward a liquid receiving medium by means of a liquid ejection head (such as an application apparatus, coating apparatus, spraying apparatus, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid supply apparatus which supplies liquid for ejection to a liquid ejection head, the apparatus comprising:

a tank which stores the liquid;

a liquid supply channel through which the liquid in the tank is conveyed to the liquid ejection head;

a flow rate determination device which determines a flow rate of the liquid flowing through the liquid supply channel;

a pressure loss determination device which determines a pressure loss in a whole of the liquid supply channel according to the flow rate determined by the flow rate determination device;

a pressure loss modification device which is disposed in a portion of the liquid supply channel and modifies the pressure loss in the liquid supply channel; and a control device which controls the pressure loss modification device according to the pressure loss in the whole of the liquid supply channel determined by the pressure loss determination device, in such a manner that the pressure loss in the whole of the liquid supply channel remains substantially constant.

2. The liquid supply apparatus as defined in claim 1, wherein the flow rate determination device calculates the flow rate from ejection data for ejecting the liquid from the liquid ejection head.

3. The liquid supply apparatus as defined in claim 1, further comprising:

a temperature determination device which determines a temperature of the liquid in the liquid supply channel; and a viscosity determination device which determines a viscosity of the liquid according to the temperature determined by the temperature determination device, wherein the pressure loss determination device includes a calculation device which calculates the pressure loss in the liquid supply channel according to the viscosity determined by the viscosity determination device.

4. The liquid supply apparatus as defined in claim 1, further comprising:

a reference value storage device which stores a prescribed reference value forming a control target value for the pressure loss in the whole of the liquid supply channel, wherein the control device performs comparison of the pressure loss in the whole of the liquid supply channel determined by the pressure loss determination device, with the reference value, and controls the pressure loss modification device according to a result of the comparison, in such a manner that the pressure loss in the whole of the liquid supply channel is substantially equal to the reference value.

5. The liquid supply apparatus as defined in claim 1, wherein the pressure loss modification device comprises a cross-sectional area adjustment device which adjusts a cross-sectional area of the portion of the liquid supply channel.

6. The liquid supply apparatus as defined in claim 5, wherein the cross-sectional area adjustment device presses an elastic tube.

7. The liquid supply apparatus as defined in claim 6, wherein the cross-sectional area adjustment device including a movable plate which has a prescribed length in a direction of the liquid supply channel and presses the elastic tube so as to constrict a diameter of the liquid supply channel over the prescribed length.

8. The liquid supply apparatus as defined in claim 5, wherein the pressure loss modification device combines use of the cross-sectional area adjustment device and a heating device which heats the liquid in the portion of the liquid supply channel.

9. The liquid supply apparatus as defined in claim 1, wherein the pressure loss modification device comprises a heating device which heats the liquid in the portion of the liquid supply channel.

10. The liquid supply apparatus as defined in claim 9, further comprising a head heating device which heats the liquid ejection head in such a manner that a temperature of the liquid in the liquid ejection head is constantly higher than the temperature of the liquid in the liquid supply channel.

11. An inkjet recording apparatus, comprising:

the liquid supply apparatus as defined in claim 1; and the liquid ejection head which receives a supply of ink forming the liquid for ejection, from the liquid supply apparatus, wherein an image is formed on a recording medium by means of ink droplets ejected from ejection ports of the liquid ejection head.

12. The inkjet recording apparatus as defined in claim 11, wherein the flow rate determination device includes an ink flow rate calculation device which determines an ink flow rate from ejection data for ejecting the ink from the liquid ejection head.

13. The liquid supply apparatus as defined in claim 1, wherein the control device controls the pressure loss modification device according to comparison of the pressure loss in the whole of the liquid supply channel determined by the pressure loss determination device with a previously stored prescribed reference value so as to control an amount of increase or decrease in the pressure loss in the whole of the liquid supply channel determined by the pressure loss determination device with respect to the reference value by means of the pressure loss modification device, in such a manner that the pressure loss in the whole of the liquid supply channel remains substantially constant.

14. A liquid supply method of supplying liquid for ejection to a liquid ejection head, the method comprising the steps of:

providing a pressure loss modification device in a portion of a liquid supply channel through which the liquid in a tank storing the liquid is conveyed to the liquid ejection head, the pressure loss modification device modifying a pressure loss in the liquid supply channel;

determining a pressure loss in a whole of the liquid supply channel according to a flow rate of the liquid flowing through the liquid supply channel; and controlling the pressure loss modification device according to the pressure loss determined in the pressure loss determining step, in such a manner that the pressure loss in the whole of the liquid supply channel is substantially equal to a prescribed reference value.

15. A liquid supply apparatus which supplies liquid for ejection to a liquid ejection head, the apparatus comprising:

a tank which stores the liquid;

a liquid supply channel through which the liquid in the tank is conveyed to the liquid ejection head;

an ejection data pre-reading device which pre-reads and acquires ejection data for ejecting the liquid from the liquid ejection head after a previously established prescribed pre-reading time differential;

flow rate determination device which determines a flow rate of the liquid flowing through the liquid supply channel, from the ejection data which is pre-read and acquired by the ejection data pre-reading device;

a temperature determination device which determines a temperature of the liquid in the liquid supply channel;

a viscosity determination device which determines a viscosity of the liquid according to the temperature of the liquid determined by the temperature determination device;

a pressure loss determination device which determines a pressure loss in a whole of the liquid supply channel, according to the flow rate of the liquid determined by the flow rate determination device and the viscosity of the liquid determined by the viscosity determination device;

a pressure loss modification device which is disposed in a portion of the liquid supply channel and modifies the pressure loss in the liquid supply channel; and a control device which controls the pressure loss modification device after a time differential which is derived from taking account of a response of the pressure loss modification device with respect to the pre-reading time differential, according to comparison of the pressure loss in the whole of the liquid supply channel determined by the pressure loss determination device with a previously stored prescribed reference value so as to control an amount of increase or decrease in the pressure loss in the whole of the liquid supply channel determined by the pressure loss determination device with respect to the reference value by means of the pressure loss modification device, in such a manner that the pressure loss in the whole of the liquid supply channel remains substantially constant.

16. A liquid supply method of supplying liquid for ejection to a liquid ejection head, the method comprising the steps of:

providing a pressure loss modification device in a portion of a liquid supply channel through which the liquid in a tank storing the liquid is conveyed to the liquid ejection head, the pressure loss modification device modifying a pressure loss in the liquid supply channel;

pre-reading and acquiring ejection data for ejecting the liquid from the liquid ejection head after a previously established prescribed pre-reading time differential;

determining a flow rate of the liquid flowing through the liquid supply channel, from the ejection data which is pre-read and acquired;

determining a temperature of the liquid in the liquid supply channel and determining a viscosity of the liquid according to the determined temperature;

determining a pressure loss in a whole of the liquid supply channel, according to the determined flow rate of the liquid and the determined viscosity of the liquid; and controlling the pressure loss modification device after a time differential which is derived from taking account of a response of the pressure loss modification device with respect to the pre-reading time differential, according to comparison of the determined pressure loss in the whole of the liquid supply channel with a previously stored prescribed reference value so as to control an amount of increase or decrease in the determined pressure loss in the whole of the liquid supply channel with respect to the reference value by means of the pressure loss modification device, in such a manner that the pressure loss in the whole of the liquid supply channel remains substantially constant.

* * * * *